US012774181B2

(12) United States Patent
Shimosaka et al.

(10) Patent No.: US 12,774,181 B2
(45) Date of Patent: Oct. 27, 2026

(54) MEDIA CONVEYING APPARATUS, MEDIA FEEDING METHOD, AND NON-TRANSITORY RECORDING MEDIUM

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/767,710

(22) Filed: Jul. 9, 2024

(65) Prior Publication Data

US 2024/0359934 A1 Oct. 31, 2024

Related U.S. Application Data

(63) Continuation of application No. PCT/JP2022/003417, filed on Jan. 28, 2022.

(51) Int. Cl.

| | |
|---|---|
| ***B65H 3/06*** | (2006.01) |
| ***B65H 7/12*** | (2006.01) |
| ***B65H 7/20*** | (2006.01) |

(52) U.S. Cl.

CPC ..... *B65H 7/12* (2013.01); *B65H 3/0669* (2013.01); *B65H 7/20* (2013.01); *B65H 2301/4234* (2013.01); *B65H 2511/524* (2013.01); *B65H 2601/273* (2013.01); *B65H 2801/12* (2013.01)

(58) Field of Classification Search

CPC ..... B65H 7/12; B65H 3/0669; B65H 7/20; B65H 2301/4234; B65H 2511/524; B65H 2601/273; B65H 2801/12

See application file for complete search history.

(56) References Cited

U.S. PATENT DOCUMENTS

| | | | |
|---|---|---|---|
| 5,118,091 | A | 6/1992 | Nagamoto et al. |
| 6,234,470 | B1 | 5/2001 | Okitsu et al. |
| 8,777,220 | B2 | 7/2014 | Oshiro et al. |
| 10,118,779 | B2 | 11/2018 | Miyauchi et al. |
| 2007/0048060 | A1 | 3/2007 | Sonoda |
| 2008/0203652 | A1 | 8/2008 | Yasukawa et al. |
| 2014/0061998 | A1 | 3/2014 | Kasashima et al. |

(Continued)

FOREIGN PATENT DOCUMENTS

| | | | |
|---|---|---|---|
| JP | H02-075443 | U | 6/1990 |
| JP | H04-028638 | A | 1/1992 |

(Continued)

OTHER PUBLICATIONS

Machine translation of JP6-107356. (Year: 1994).*

(Continued)

*Primary Examiner* — Thomas A Morrison

(74) *Attorney, Agent, or Firm* — Womble Bond Dickinson (US) LLP

(57) ABSTRACT

A media conveying apparatus includes a media table, a feed roller to feed a medium placed on the media table, a separation roller located to face the feed roller, a first motor to drive the feed roller, a second motor to drive the separation roller, and circuitry. The circuitry determines whether multi-feed of the medium has occurred and controls the first motor and the second motor such that the feed roller rotates after the separation roller rotates to return the medium to the media table when it is determined that the multi-feed of the medium has occurred.

9 Claims, 14 Drawing Sheets

(56) References Cited

U.S. PATENT DOCUMENTS

| | | | |
|---|---|---|---|
| 2016/0090250 | A1 | 3/2016 | Saito et al. |
| 2016/0289028 | A1 | 10/2016 | Kuriki |
| 2017/0107068 | A1 | 4/2017 | Kanamitsu |
| 2017/0366696 | A1 | 12/2017 | Koyanagi et al. |
| 2018/0002124 | A1 | 1/2018 | Miyauchi et al. |
| 2018/0118480 | A1 | 5/2018 | Kuriki |
| 2019/0193967 | A1 | 6/2019 | Shuto et al. |
| 2019/0367307 | A1 | 12/2019 | Kanamitsu |
| 2020/0071100 | A1 | 3/2020 | Namiki et al. |

FOREIGN PATENT DOCUMENTS

| | | | | |
|---|---|---|---|---|
| JP | 6-9108 | | * | 1/1994 |
| JP | 6-107356 | | * | 4/1994 |
| JP | H06-171800 | A | | 6/1994 |
| JP | 6-183588 | | * | 7/1994 |
| JP | H11-263464 | A | | 9/1999 |
| JP | 2007-062975 | A | | 3/2007 |
| JP | 2008-207944 | A | | 9/2008 |
| JP | 2008-239330 | | * | 10/2008 |
| JP | 2012-51720 | A | | 3/2012 |
| JP | 2014-047050 | A | | 3/2014 |
| JP | 2014-101193 | A | | 6/2014 |
| JP | 5559843 | B | | 7/2014 |
| JP | 2014-196194 | A | | 10/2014 |
| JP | 2015-160688 | A | | 9/2015 |
| JP | 2016-069157 | A | | 5/2016 |
| JP | 2016-113270 | A | | 6/2016 |
| JP | 2016-190708 | A | | 11/2016 |
| JP | 2017-77944 | A | | 4/2017 |
| JP | 2017-171425 | A | | 9/2017 |
| JP | 2017-178601 | A | | 10/2017 |
| JP | 2017-224994 | A | | 12/2017 |
| JP | 2018-70320 | A | | 5/2018 |
| JP | 2019-001594 | A | | 1/2019 |
| JP | 2019-116383 | A | | 7/2019 |
| JP | 2020-037483 | A | | 3/2020 |
| JP | 6819851 | B | | 1/2021 |
| JP | 2021-46269 | A | | 3/2021 |

OTHER PUBLICATIONS

Machine translation of JP2008-239330. (Year: 2008).*
Machine translation of JP6-9108. (Year: 1994).*
International Search Report dated Mar. 8, 2022 for corresponding PCT Application No. PCT/JP2022/003417 (3 pages) with English Translation (2 pages).
Written Opinion dated Mar. 8, 2022 for corresponding PCT Application No. PCT/JP2022/003417 (3 pages) with English Translation (3 pages).
International Preliminary Report on Patentability dated Jul. 30, 2024 for corresponding PCT Application No. PCT/JP2022/003417 (4 pages) with English Translation (4 pages).
International Search Report dated Mar. 8, 2022 for corresponding PCT Application No. PCT/JP2022/003421 (3 pages) with English Translation (2 pages).
Written Opinion dated Mar. 8, 2022 for corresponding PCT Application No. PCT/JP2022/003421 (3 pages) with English Translation (3 pages).
International Preliminary Report on Patentability dated Jul. 30, 2024 for corresponding PCT Application No. PCT/JP2022/003421 (4 pages) with English Translation (4 pages).
Notice of Dispatch of Duplicates of a Written Opposition dated Mar. 3, 2025 regarding Japanese Patent No. 7528385 (Opposition No. 2025-700146) a counterpart of U.S. Appl. No. 18/604,146, which relates to U.S. Appl. No. 18/767,710 (2 pages) with English Translation (1 pages).
Patent Opposition Statement dated Feb. 4, 2025 regarding Japanese Patent No. 7528385 (Opposition No. 2025-700146) a counterpart of U.S. Appl. No. 18/604,146, which relates to U.S. Appl. No. 18/767,710 (142 pages) with English Translation (106 pages).
Japanese Office Action dated Jul. 1, 2025 regarding Japanese Patent Application No. 2024-118451 corresponding to U.S. Appl. No. 18/767,710 (3 pages) with English Translation (6 pages).
Notice of Reasons for Revocation dated Apr. 23, 2025 regarding Japanese Patent No. 7528385 (Opposition No. 2025-700146) a counterpart of U.S. Appl. No. 18/604,146, which relates to U.S. Appl. No. 18/767,710 (73 pages) with English Translation (60 pages).
Office Action dated Jul. 29, 2025 regarding U.S. Appl. No. 18/604,146 corresponding counterpart to U.S. Appl. No. 18/767,710 (21 pages).
Japanese Office Action dated Oct. 29, 2025 regarding Opposition No. 2025-700146 to corresponding Japanese Patent No. 7528385 (18 pages) with English Translation (10 pages).
Notice of Reasons of Revocation dated Oct. 29, 2025 regarding Opposition No. 2025-700146 to corresponding Japanese Patent No. 7528385 (61 pages) with English Translation (52 pages).
Machine Translation of JP6-107356 to Itado et al., Published Apr. 4, 1994 (20 pages).
Japanese Office Action for corresponding Japanese Patent Application No. 2024-118451, mailed Jan. 13, 2026 (3 pages) with English Translation (5 pages).
Final Office Action dated Apr. 29, 2026 for related U.S. Appl. No. 18/604,146 (20 pages).
Japanese Office Action dated Mar. 3, 2026 for related Japanese Patent Application No. 2025-061891 (3 pages) with English Translation (5 pages).
Notice of Dispatch of Duplicates a Written Opinion mailed May 25, 2026 regarding Opposition No. 2025-700146 to corresponding Japanese Patent No. 7528385 (20 pages) with English Translation (13 pages).
Decision on Opposition mailed May 26, 2026 regarding Opposition No. 2025-700146 to corresponding Japanese Patent No. 7528385 (68 pages—Part 1) with English Translation (50 pages—Part 2).
The First Office Action for corresponding Chinese Patent Application No. 202280079522.8, mailed Jul. 15, 2026 (10 pages) with English translation (15 pages).
Office Action dated Aug. 24, 2026 regarding U.S. Appl. No. 18/604,146 corresponding counterpart to U.S. Appl. No. 18/767,710 (17 pages).

* cited by examiner

MEDIA CONVEYING APPARATUS, MEDIA FEEDING METHOD, AND NON-TRANSITORY RECORDING MEDIUM

CROSS-REFERENCE TO RELATED APPLICATION

This patent application is a continuation application of International Application No. PCT/JP2022/003417, having an international filing date of Jan. 28, 2022, the entire disclosure of which is hereby incorporated by reference herein.

BACKGROUND

The present disclosure relates to a media conveying apparatus, a media feeding method, and a non-transitory recording medium.

When multi-feed of a medium occurs in a media conveying apparatus such as a scanner that sequentially feeds multiple media while separating the media from each other and images the media, the user needs to remove the media from the inside of a housing and reset the media on a media table.

SUMMARY

According to an embodiment of the present disclosure, a media conveying apparatus includes a media table, a feed roller to feed a medium placed on the media table, a separation roller located to face the feed roller, a first motor to drive the feed roller, a second motor to drive the separation roller, and circuitry. The circuitry determines whether multi-feed of the medium has occurred and controls the first motor and the second motor such that the feed roller rotates after the separation roller rotates to return the medium to the media table when it is determined that the multi-feed of the medium has occurred.

According to an embodiment of the present disclosure, a media feeding method includes feeding a medium placed on a media table by a feed roller; determining whether multi-feed of the medium has occurred; and controlling a first motor to drive the feed roller and a second motor to drive a separation roller located to face the feed roller, such that after temporarily stopping the medium, the feed roller rotates after the separation roller rotates to return the medium to the media table when it is determined that the multi-feed of the medium has occurred.

According to an embodiment of the present disclosure, a non-transitory recording medium stores a plurality of instructions which, when executed by one or more processors, causes the one or more processors to perform a method for controlling a media conveying apparatus. The method includes determining whether multi-feed of the medium has occurred, and controlling a first motor to drive a feed roller and a second motor to drive a separation roller located to face the feed roller, such that after temporarily stopping the medium, the feed roller rotates after the separation roller rotates to return the medium to a media table when it is determined that the multi-feed of the medium has occurred.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
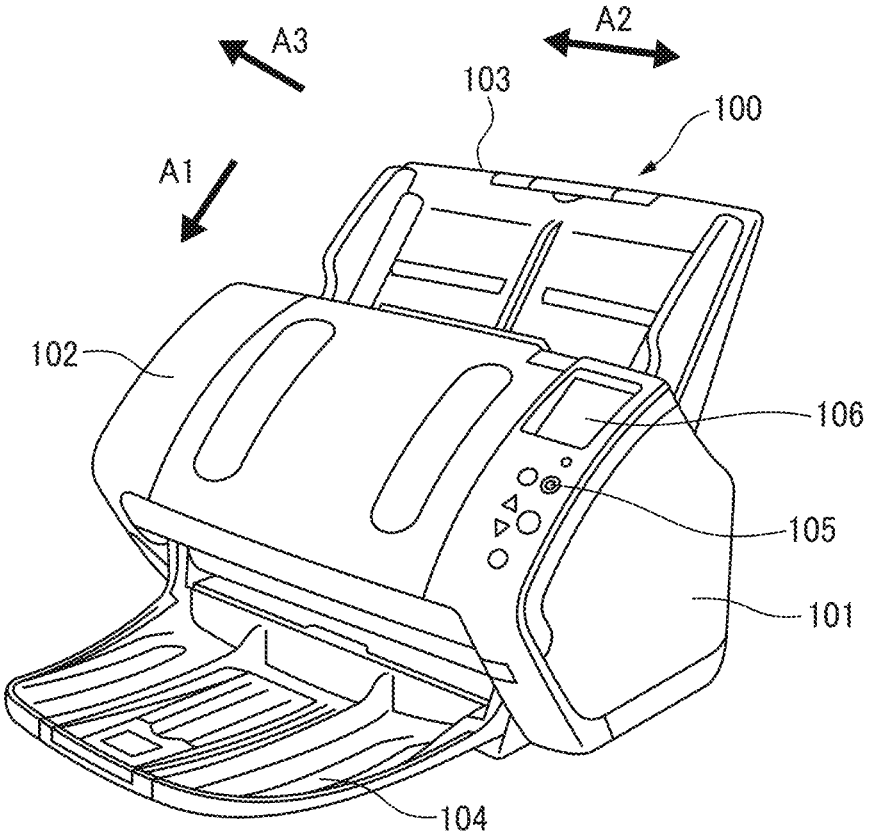
FIG. 1 is a perspective view of a media conveying apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below.

As used herein, the singular forms "a," "an," and "the" are intended to include the plural forms as well, unless the context clearly indicates otherwise. The term "connected/coupled" includes both direct connections and connections in which there are one or more intermediate connecting elements.

For the sake of simplicity, like reference signs denote like elements such as parts and materials having the same functions, and redundant descriptions thereof are omitted unless otherwise required.

The advantages of the present disclosure are recognized and achieved by the elements particularly pointed out in the appended claims and the combinations thereof. It is to be understood that both the above-described general description and the detailed description described below are exemplary and explanatory only and are not intended to restrict the claimed invention.

A description is given below of a media conveying apparatus, a media feeding method, and a control program according to embodiments of the present disclosure, with reference to the drawings. The technical scope of the present disclosure, however, is not limited to the embodiments described below but includes the scope of the appended claims and the equivalents thereof.

FIG. 1 is a perspective view of a media conveying apparatus 100 as an image scanner. The media conveying apparatus 100 conveys and images media being documents. The media are, for example, sheets of plain paper, sheets of thin paper, sheets of thick paper, cards, booklets, or passports. Alternatively, the media conveying apparatus 100 may be, for example, a facsimile machine, a copier, or a multifunction peripheral (MFP). The media to be conveyed may be, for example, printing material (e.g., paper sheets) instead of documents. In this case, the media conveying apparatus 100 may be a printer, etc.

The media conveying apparatus 100 includes a lower housing 101, an upper housing 102, a media table 103, an ejection table 104, an operation device 105, and a display device 106. In FIG. 1, arrow A1 indicates a media conveyance direction in which media are conveyed. An arrow A2 indicates a width direction orthogonal to the media conveyance direction. An arrow A3 indicates a height direction orthogonal to a media conveyance passage. In the following description, the media conveyance direction indicated by arrow A1, the width direction indicated by arrow A2, and the height direction indicated by arrow A3 may be referred to as a media conveyance direction A1, a width direction A2, and a height direction A3, respectively. In the following description, the term "upstream" refers to upstream in the media conveyance direction A1 whereas the term "downstream" refers to downstream in the media conveyance direction A1.

The upper housing 102 is located at a position covering the upper face of the media conveying apparatus 100 and is hinged to the lower housing 101 such that the upper housing 102 can be opened and closed to, for example, remove a jammed medium or clean the inside of the media conveying apparatus 100.

The media table 103 is engaged with the lower housing 101. Media to be fed and conveyed are placed on the media table 103. The ejection table 104 is engaged with the upper housing 102 and stack ejected media. The ejection table 104 may be engaged with the lower housing 101.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display and displays the image data on the display. Examples of the display include, but are not limited to, a liquid crystal and an organic electro-luminescence (EL).

Figure 2:
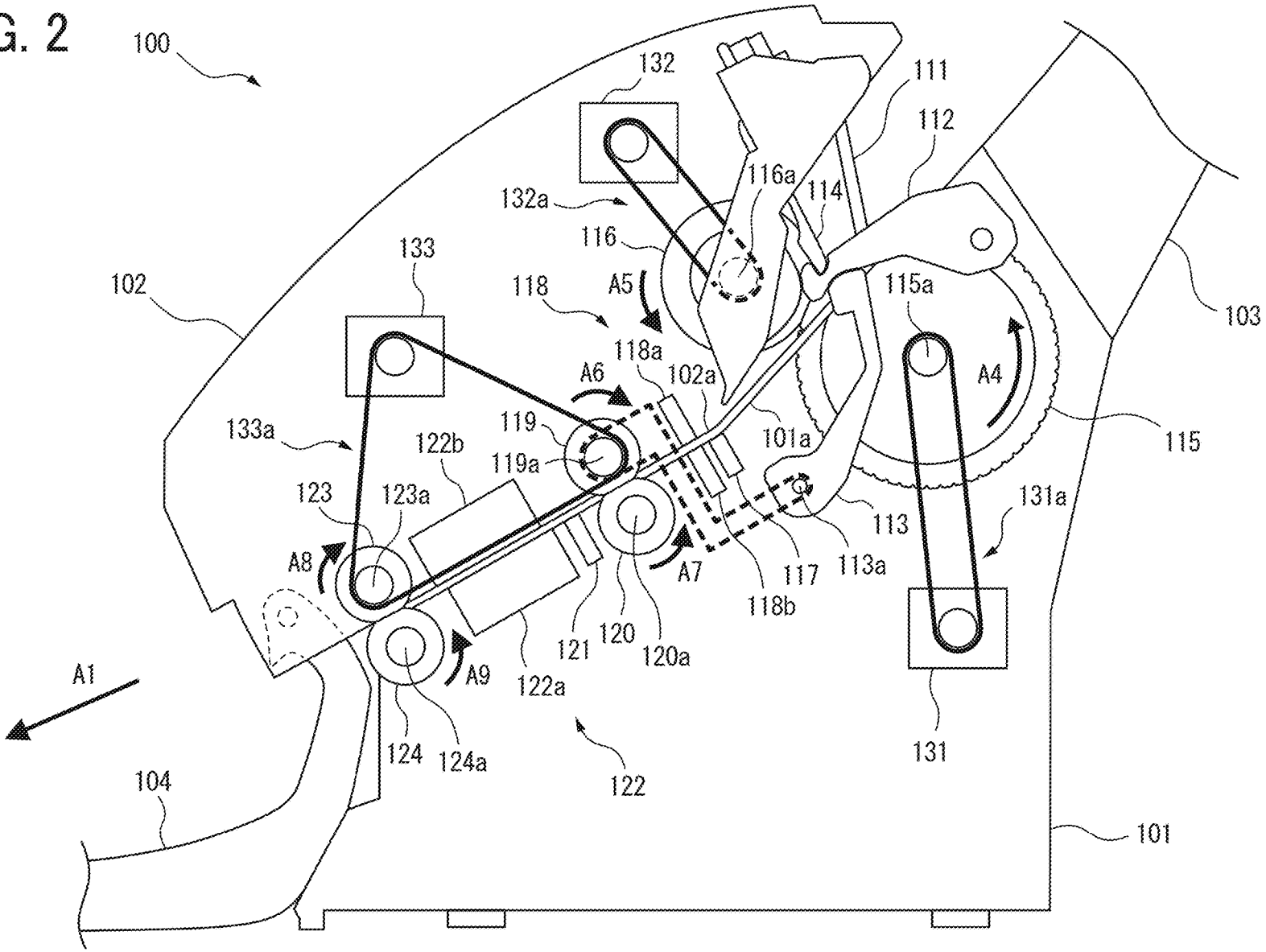
FIG. 2 is a diagram illustrating a conveyance passage inside the media conveying apparatus of FIG. 1.

FIG. 2 is a diagram illustrating a conveyance passage inside the media conveying apparatus 100.

The media conveying apparatus 100 includes a first media sensor 111, a restriction guide 112, a cam 113, a flap 114, a feed roller 115, a separation roller 116, a second media sensor 117, an ultrasonic sensor 118, a conveyance roller 119, a first facing roller 120, a third media sensor 121, an imaging device 122, an ejection roller 123, and a second facing roller 124 along the conveyance passage.

The number of each of the feed roller 115, the separation roller 116, the conveyance roller 119, the first facing roller 120, the ejection roller 123, and/or the second facing roller 124 is not limited to one, and may be two or more. In this case, the two or more rollers of the feed rollers 115, the separation rollers 116, the conveyance rollers 119, the first facing rollers 120, the ejection rollers 123, and/or the second facing rollers 124 are aligned and spaced apart in the width direction A2 orthogonal to the media conveyance direction A1.

The upper face of the lower housing 101 forms a lower guide 101*a* for the media conveyance passage. The lower face of the upper housing 102 forms an upper guide 102*a* for the media conveyance passage.

The first media sensor 111 is located upstream from the feed roller 115 and the separation roller 116. The first media sensor 111 includes a contact sensor and detects whether a medium is placed on the media table 103. The first media sensor 111 generates and outputs a first media signal whose signal value changes depending on whether a medium is placed on the media table 103. The first media sensor 111 is not limited to the contact sensor. The first media sensor 111 may be any other sensor that can detect the presence of a medium, such as an optical sensor.

The feed roller 115 is located in the lower housing 101 and sequentially separates and feeds the media on the media table 103 from the bottom. The separation roller 116 is a so-called brake roller or retard roller. The separation roller 116 is located in the upper housing 102 to face the feed roller 115. The separation roller 116 is stoppable or rotatable in a direction opposite to a media feeding direction. Alternatively, the feed roller 115 may be located in the upper housing 102 and the separation roller 116 may be located in the lower housing 101, and the feed roller 115 may feed the media on the media table 103 from the top.

The second media sensor 117 is located downstream from the feed roller 115 and upstream from the conveyance roller 119. The second media sensor 117 detects the medium conveyed to the position of the second media sensor 117. The second media sensor 117 includes a light emitter, a light receiver, and a light guide. The light emitter and the light receiver are located on one side of the media conveyance passage. The light guide faces the light emitter and the light receiver across the media conveyance passage. The light emitter is, for example, a light emitting diode (LED) and emits light toward the media conveyance passage. By contrast, the light receiver is, for example, a photodiode and receives light that is emitted by the light emitter and guided by the light guide. When a medium faces the second media sensor 117, the light emitted from the light emitter is blocked by the medium, and therefore, the light receiver does not detect the light emitted from the light emitter. Based on the intensity of the light received by the light receiver, the second media sensor 117 generates and outputs a second media signal whose signal value changes depending on whether a medium is present at the position of the second media sensor 117.

A reflector such as a mirror may be used instead of the light guide. The light emitter and the light receiver may face each other across the media conveyance passage. The second media sensor 117 may detect the presence of a medium with, for example, a contact sensor that causes a predetermined current to flow when a medium is in contact with the contact sensor or when no medium is in contact with the contact sensor.

The ultrasonic sensor 118 is located downstream from the feed roller 115, particularly from the second media sensor 117, and upstream from the conveyance roller 119. The ultrasonic sensor 118 includes an ultrasonic transmitter 118*a* and an ultrasonic receiver 118*b*. The ultrasonic transmitter 118*a* and the ultrasonic receiver 118*b* are located near the media conveyance passage and face each other across the media conveyance passage. The ultrasonic transmitter 118*a* transmits ultrasonic waves. The ultrasonic receiver 118*b* receives the ultrasonic waves having been transmitted by the ultrasonic transmitter 118*a* and have penetrated a medium. The ultrasonic receiver 118*b* generates and outputs an ultrasonic signal which is an electrical signal corresponding to the received ultrasonic waves. When multiple media are conveyed in overlapped state, the ultrasonic waves penetrating the media are attenuated by an air layer between the media conveyed in overlapped state. Accordingly, the media conveying apparatus 100 can detect the multi-feed of the medium based on the ultrasonic signal.

The conveyance roller 119 and the first facing roller 120 are located downstream from the feed roller 115 and the separation roller 116 in the media conveyance direction A1 and face each other. The conveyance roller 119 is located in the upper housing 102 and conveys the medium fed by the feed roller 115 and the separation roller 116 to the imaging device 122. Alternatively, the conveyance roller 119 may be located in the lower housing 101 and the first facing roller 120 may be located in the upper housing 102.

The third media sensor 121 is located downstream from the conveyance roller 119 and upstream from the imaging device 122. The third media sensor 121 detects the medium conveyed to the position of the third media sensor 121. The third media sensor 121 includes a light emitter, a light receiver, and a light guide. The light emitter and the light receiver are located on one side of the media conveyance passage. The light guide faces the light emitter and the light receiver across the media conveyance passage. The light emitter is, for example, an LED and emits light toward the media conveyance passage. The light receiver is, for example, a photodiode and receives light that is emitted by the light emitter and guided by the light guide. Based on the intensity of the light received by the light receiver, the third media sensor 121 generates and outputs a third media signal whose signal value changes depending on whether a medium is present at the position of the third media sensor 121.

A reflector such as a mirror may be used instead of the light guide. The light emitter and the light receiver may face each other across the media conveyance passage. The third media sensor 121 may detect the presence of a medium with, for example, a contact sensor that causes a predetermined current to flow when a medium is in contact with the contact sensor or when no medium is in contact with the contact sensor.

The imaging device 122 is located downstream from the conveyance roller 119 and the first facing roller 120 in the media conveyance direction A1 and images the medium conveyed by the conveyance roller 119 and the first facing roller 120. The imaging device 122 includes a first imaging device 122*a* and a second imaging device 122*b* facing each other across the media conveyance passage.

The first imaging device 122*a* includes a line sensor based on a unity-magnification optical system type contact image sensor (CIS) including complementary metal oxide semiconductor-(CMOS-) based imaging elements linearly arranged in a main scanning direction. The first imaging device 122*a* further includes lenses each forming an image on an imaging element, and an analog-to-digital (A/D) converter amplifying and converting an electric signal output from the imaging element. The first imaging device 122*a* generates an input image by imaging the front side of a conveyed medium in accordance with control from a processing circuit to be described later and outputs the generated image.

Similarly, the second imaging device 122*b* includes a line sensor based on a unity-magnification optical system type CIS including CMOS-based imaging elements linearly arranged in the main scanning direction. The second imaging device 122*b* further includes lenses each forming an image on an imaging element, and an A/D converter amplifying and analog-digital (A/D) converting an electric signal output from the imaging element. The second imaging device 122*b* generates an input image by imaging the back side of a conveyed medium in accordance with control from the processing circuit to be described later and outputs the generated image.

The media conveying apparatus 100 may include either the first imaging device 122*a* or the second imaging device 122*b* and reads only one side of the medium. Further, a line sensor based on a unity-magnification optical system type CIS including charge coupled device-(CCD-) based imaging elements may be used in place of the line sensor based on a unity-magnification optical system type CIS including CMOS-based imaging elements. Further, a reduction optical system type line sensor including CMOS-based or CCD-based imaging elements may be used.

The ejection roller 123 and the second facing roller 124 are located downstream from the imaging device 122, that is, the conveyance roller 119 and the first facing roller 120 in the media conveyance direction A1 and face each other. The ejection roller 123 is located in the upper housing 102. The ejection roller 123 conveys the medium conveyed by the conveyance roller 119 and the first facing roller 120 further downstream and ejects the medium to the ejection table 104. Alternatively, the ejection roller 123 may be located in the lower housing 101 and the second facing roller 124 may be located in the upper housing 102.

As the feed roller 115 rotates in the media feeding direction indicated by arrow A4, the medium is conveyed from the media table 103 in the media conveyance direction A1 between the lower guide 101*a* and the upper guide 102*a*. The media conveying apparatus 100 has two feeding modes: a separation mode in which media are fed while being separated and a non-separation mode in which media are fed without being separated. The feeding mode is set by a user using the operation device 105 or an information processing device communicably connected to the media conveying apparatus 100. When the feeding mode is set to the separation mode, the separation roller 116 stops or rotates in the direction indicated by arrow A5 opposite to the media feeding direction. Due to the operations of the feed roller 115 and separation roller 116, only the medium in contact with the feed roller 115 among the multiple media placed on the media table 103 is separated. This prevents the feeding of a medium other than the separated medium. In other words, the multi-feed is prevented. By contrast, when the feeding mode is set to the non-separation mode, the separation roller 116 rotates in the media feeding direction opposite to the direction indicated by arrow A5.

The medium is fed between the conveyance roller 119 and the first facing roller 120 while being guided by the lower guide 101*a* and the upper guide 102*a*. As the conveyance roller 119 and the first facing roller 120 rotate in the directions indicated by arrows A6 and A7, respectively, the medium is fed between the first imaging device 122*a* and the second imaging device 122*b*. As the ejection roller 123 and the second facing roller 124 rotate in the directions indicated by arrows A8 and A9, respectively, the medium read by the imaging device 122 is ejected to the ejection table 104.

As illustrated in FIG. 2, the media conveying apparatus 100 includes a first motor 131, a second motor 132, and a third motor 133 as driving sources of the rollers described above.

The first motor 131 is located in the lower housing 101. The first motor 131 is coupled to the feed roller 115 via a first transmission assembly 131*a* and drives the feed roller 115. The first motor 131 generates a driving force for driving the feed roller 115 according to control signals from the processing circuit. The first transmission assembly 131*a* includes one or more pulleys, belts, and gears between the first motor 131 and a shaft 115*a* serving as a rotary shaft of the feed roller 115. The first transmission assembly 131*a* transmits the driving force generated by the first motor 131 to the feed roller 115. With this configuration, the first motor 131 rotates the feed roller 115 to feed media. Alternatively, the first motor 131 may be located in the upper housing 102.

The second motor 132 is located in the upper housing 102 separately from the first motor 131. The second motor 132 is coupled to the separation roller 116 via a second transmission assembly 132*a* and drives the separation roller 116. The second motor 132 generates a driving force for driving the separation roller 116 according to control signals from the processing circuit. The second transmission assembly 132*a* includes one or more pulleys, belts, and gears between the second motor 132 and a shaft 116*a* serving as a rotary shaft of the separation roller 116. The second transmission assembly 132*a* transmits the driving force generated by the second motor 132 to the separation roller 116. With this configuration, the second motor 132 rotates the separation roller 116 and causes the separation roller 116 to separate, feed, and convey media. Alternatively, the second motor 132 may be located in the lower housing 101.

The third motor 133 is located in the upper housing 102 separately from the first motor 131 and the second motor 132. The third motor 133 is coupled to the conveyance roller 119, the ejection roller 123, and the cam 113 via a third transmission assembly 133*a* and drives the conveyance roller 119, the ejection roller 123, and the cam 113. The third motor 133 generates a driving force for driving the conveyance roller 119, the ejection roller 123, and the cam 113 according to control signals from the processing circuit. The third transmission assembly 133*a* includes one or more pulleys, belts, and gears between the third motor 133, a shaft 119*a* serving as a rotary shaft of the conveyance roller 119, a shaft 123*a* serving as a rotary shaft of the ejection roller 123, and a rotary shaft 113*a* of the cam 113. The third transmission assembly 133*a* transmits the driving force generated by the third motor 133 to the conveyance roller 119, the ejection roller 123, and the cam 113. With this configuration, the third motor 133 rotates the conveyance roller 119 and the ejection roller 123 and causes the conveyance roller 119 and the ejection roller 123 to convey and eject media. In other words, the conveyance roller 119 and the ejection roller 123 are driven by the third motor 133. The third motor 133 rotates the cam 113 to move the restriction guide 112 in contact with the cam 113. Alternatively, the third motor 133 may be located in the lower housing 101.

As described above, the media conveying apparatus 100 includes the common motor to drive the conveyance roller 119 and the ejection roller 123 and to move the restriction guide 112. Accordingly, the media conveying apparatus 100 can reduce the number of motors and reduce the cost and weight of the media conveying apparatus 100.

The first facing roller 120 is a driven roller that is rotated by the rotation of the conveyance roller 119. The second facing roller 124 is a driven roller that is rotated by the rotation of the ejection roller 123. Alternatively, the first facing roller 120 and/or the second facing roller 124 may be driven by the driving force from the third motor 133.

In this case, one or more gears are further located between the shaft 119*a* of the conveyance roller 119 and a shaft 120*a* serving as a rotary shaft of the first facing roller 120 and/or between the shaft 123*a* of the ejection roller 123 and a shaft 124*a* serving as a rotary shaft of the second facing roller 124, and the third transmission assembly 133*a* further transmits the driving force generated by the third motor 133 to the first facing roller 120 and/or the second facing roller 124.

Figure 3:
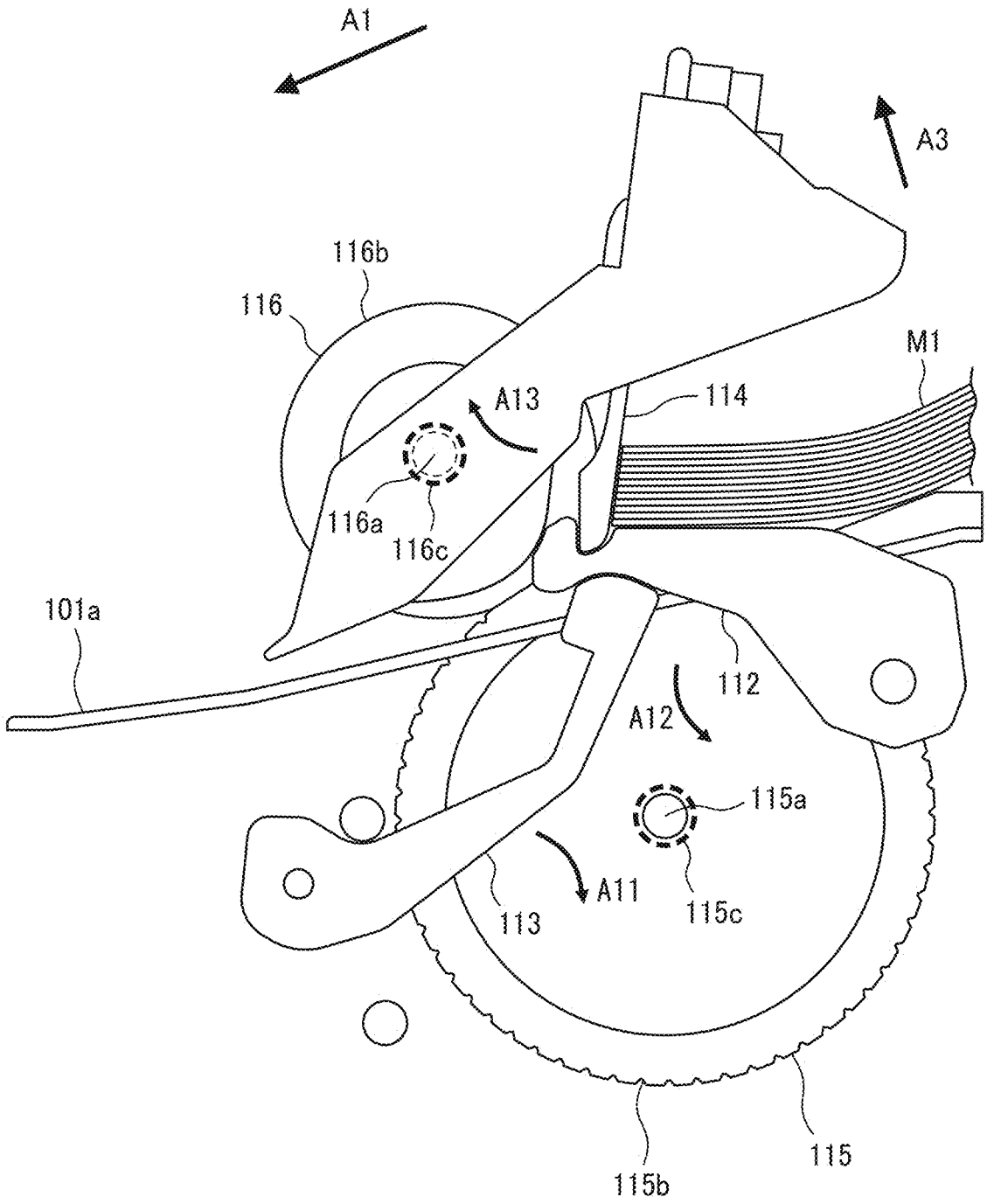
FIG. 3 is a schematic diagram illustrating a restriction guide and surrounding components in the media conveying apparatus of FIG. 1.

FIG. 3 is a schematic diagram illustrating the restriction guide 112, the cam 113, and the flap 114. Specifically, FIG. 3 is a side view of the restriction guide 112, the cam 113, and the flap 114 before media are fed.

As illustrated in FIG. 3, the restriction guide 112 is a guide for setting media (group) M1 placed on the media table 103. The restriction guide 112 is positioned to face the feed roller 115 and the separation roller 116 in the media conveyance direction A1. The restriction guide 112 is rotatably (swingably) supported by the lower housing 101 and supports the lower face of the media M1 placed on the media table 103 when the media M1 are not fed. In the following description, as illustrated in FIG. 3, the position at which the restriction guide 112 supports the lower face of the media M1 placed on the media table 103 may be referred to as a set position.

The cam 113 is a moving member for moving the restriction guide 112. The cam 113 is located downstream from the restriction guide 112 in the media conveyance direction A1. The cam 113 is rotatable (swingable) by the third motor 133. The cam 113 is supported by the lower housing 101 to be rotatable by the driving force from the third motor 133. When media are not fed, the cam 113 contacts a downstream end of the restriction guide 112 to hold the restriction guide 112 at the set position.

The flap 114 is a stopper for preventing the media M1 from entering the nip between the feed roller 115 and the separation roller 116 before the media are fed. The flap 114 is positioned to face the restriction guide 112 in the media conveyance direction A1. The flap 114 is swingably located in upper housing 102. When the media M1 are not fed, the flap 114 is engaged with the restriction guide 112 at the set position and prevents the media M1 from entering the nip between feed roller 115 and separation roller 116.

In other words, the restriction guide 112 restricts the contact of the media M1 with the feed roller 115 and the separation roller 116 at the set position. The set position is an example of a first position.

Figure 4:
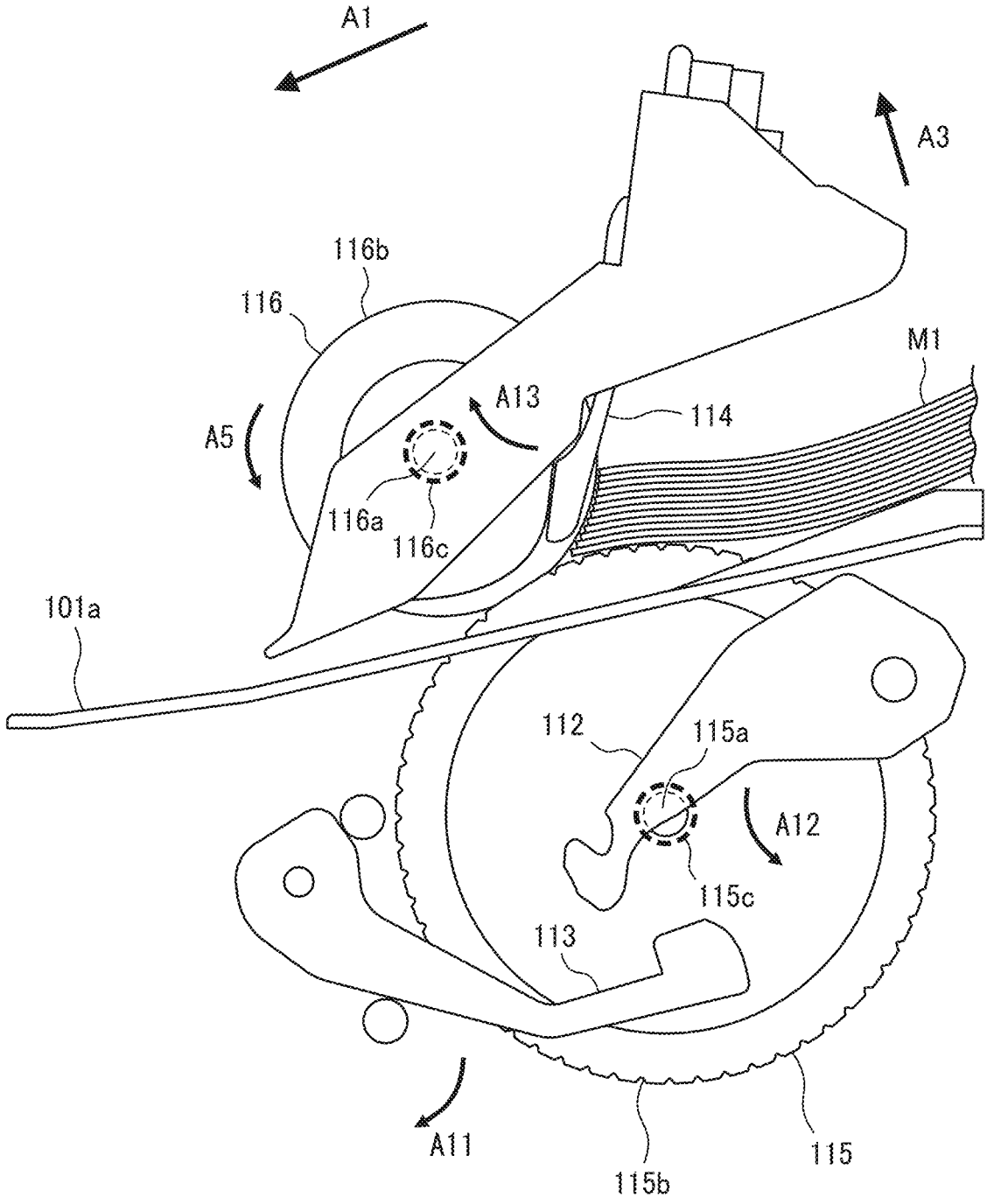
FIG. 4 is a schematic diagram illustrating the movement of the restriction guide and the surrounding components of FIG. 3.

FIG. 4 is a schematic diagram illustrating the movement of the restriction guide 112, the cam 113, and the flap 114. Specifically, FIG. 4 is a side view of the restriction guide 112, the cam 113, and the flap 114 when the media are fed.

As illustrated in FIG. 4, when the media M1 are fed, the cam 113 swings (rotates) downward (in the direction indicated by arrow A11) by the driving force from the third motor 133 and is separated from the downstream end of the restriction guide 112. When the downstream end of the restriction guide 112 is separated from the cam 113 and is not held by the cam 113, the restriction guide 112 swings downward (in the direction indicated by arrow A12) from the media conveyance face and is separated from the lower face of the media M1 placed on the media table 103. In the following description, as illustrated in FIG. 4, the position at which the restriction guide 112 is separated from the lower face of the media M1 placed on the media table 103 may be referred to as a released position. When the restriction guide 112 is at the released position, the engagement between the flap 114 and the restriction guide 112 is released. As a result, the flap 114 is pushed by the leading end of the media M1 placed on the media table 103 and swings downstream (in the direction indicated by arrow A13), allowing the media M1 to enter the nip between the feed roller 115 and the separation roller 116. As described above, when the restriction guide 112 is at the released position, the flap 114 allows the media M1 to enter the nip between the feed roller 115 and the separation roller 116.

In other words, the restriction guide 112 does not restrict the contact of the media M1 with the feed roller 115 and the separation roller 116 at the released position. The released position is an example of a second position. The restriction guide 112 is movable between the set position and the released position. The restriction guide 112 is moved by the rotation of the cam 113.

As illustrated in FIGS. 3 and 4, the feed roller 115 is provided with an outer circumferential surface 115*b*, a one-way clutch 115*c*, etc. The one-way clutch 115*c* is located on the shaft 115*a* serving as the rotary shaft of the feed roller 115. The one-way clutch 115*c* prevents (the outer circumferential surface 115*b* of) the feed roller 115 from rotating about the shaft 115*a* in the direction opposite to the media feeding direction indicated by arrow A4. This prevents the feed roller 115 from rotating in the direction opposite to the media feeding direction indicated by arrow A4 as a result of being dragged by the separation roller 116 rotating in the direction indicated by arrow A5 opposite to the media feeding direction.

The conveyance roller 119 conveys media at a speed higher than the speed at which the feed roller 115 feeds media. Therefore, when a medium reaches the position of the conveyance roller 119, the medium is pulled by the conveyance roller 119 while being sandwiched between the feed roller 115 and the separation roller 116. At this time, the outer circumferential surface 115*b* of the feed roller 115 is rotated by the sandwiched medium due to the operation of the one-way clutch 115*c* and does not hinder the conveyance of media. Alternatively, the conveyance roller 119 may convey the medium at the same speed as the speed at which the feed roller 115 feeds the medium.

The separation roller 116 is provided with, an outer circumferential surface 116*b*, a torque limiter 116*c*, etc. The torque limiter 116*c* is located on a shaft 116*a* serving as a rotary shaft of the separation roller 116. The torque limiter 116*c* defines the maximum torque applied to the separation roller 116. The limit value of the torque limiter 116*c* is set to prevent the rotational force from being transmitted through the torque limiter 116*c* when a single medium is conveyed, and to transmit the rotational force through the torque limiter 116*c* when multiple media are conveyed. As a result, when a single medium is conveyed, the separation roller 116 is rotated by the rotation of the feed roller 115, without being rotated by the driving force from the second motor 132. By contrast, when multiple media are conveyed, the separation roller 116 rotates in the direction indicated by arrow A5 opposite to the media feeding direction and separates the medium in contact with the feed roller 115 from the other media to prevent the occurrence of multi-feed. When the separation roller 116 is stoppable type and multiple media are conveyed, the outer circumferential surface 116*b* of the separation roller 116 that is stopped without rotating in the direction indicated by arrow A5 opposite to the media feeding direction may apply a force in the direction indicated by arrow A5 opposite to the media feeding direction to the media.

Figure 5:
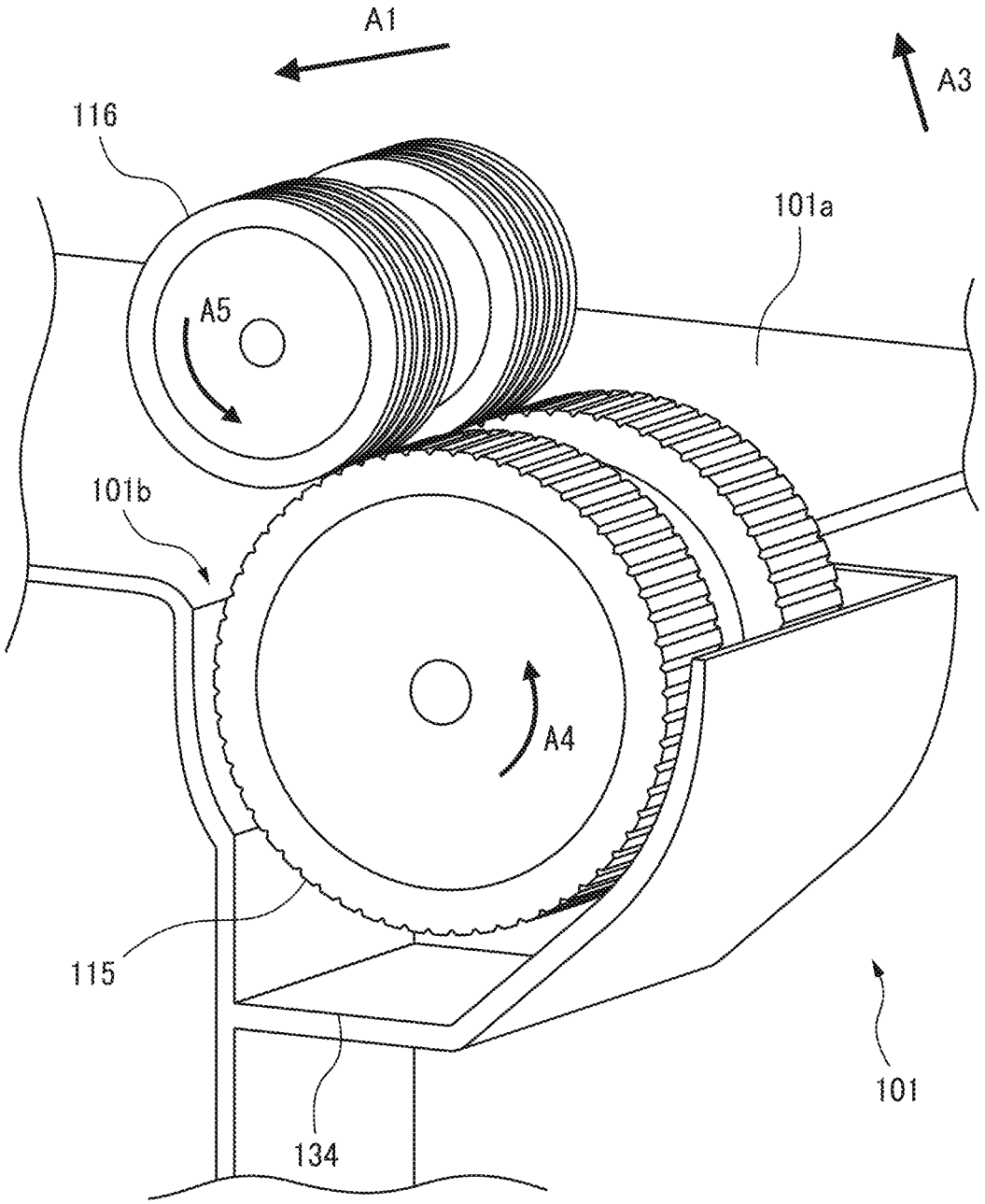
FIG. 5 is a schematic diagram illustrating a container included in the media conveying apparatus of FIG. 1.

FIG. 5 is a schematic diagram illustrating a container 134.

As illustrated in FIG. 5, the lower housing 101 is provided with the container 134. The container 134 contains dust such as paper dust or waste adhering to the media conveyed or deposited to the feed roller 115 or the separation roller 116 from the media conveyed. The lower guide 101*a*, which is a media-guiding face of the lower housing 101, has an opening 101*b* for locating the feed roller 115. The container 134 is provided below the feed roller 115 to face the opening 101*b*. The container 134 contains the dust that has fallen from the conveyed media, the feed roller 115, or the separation roller 116 and entered from the clearance between the feed roller 115 and the opening 101*b*. The container 134 is detachable from the lower housing 101, that is, from the media conveying apparatus 100. The container 134 allows the media conveying apparatus 100 to appropriately collect paper dust or waste and prevent accumulation of paper dust or waste in the media conveyance passage.

Figure 6:
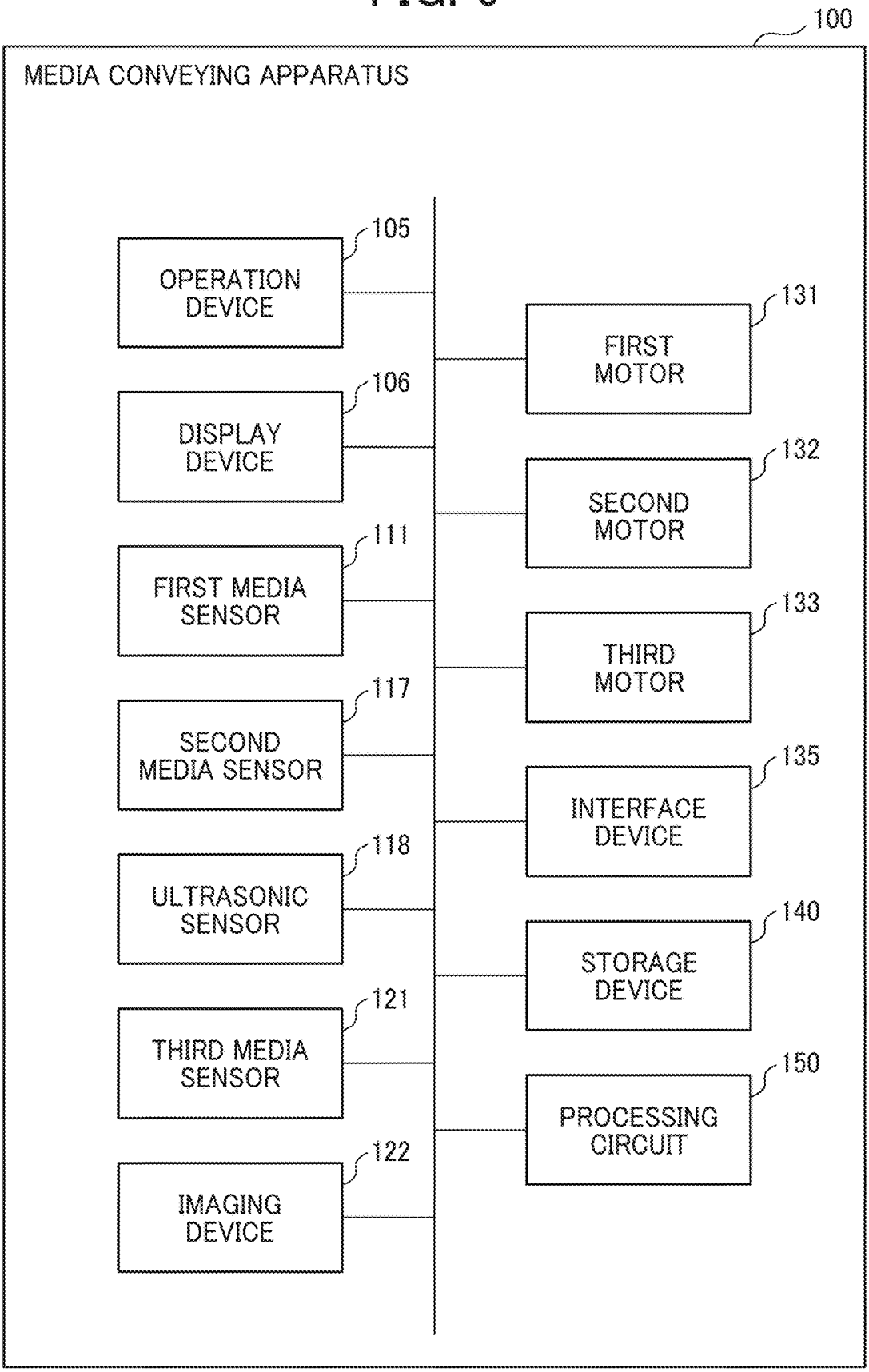
FIG. 6 is a schematic block diagram illustrating a configuration of the media conveying apparatus of FIG. 1.

FIG. 6 is a schematic block diagram illustrating a configuration of the media conveying apparatus 100.

The media conveying apparatus 100 further includes an interface device 135, a storage device 140, and a processing circuit 150, in addition to the configuration described above.

The interface device 135 includes an interface circuit in compliance with a serial bus such as a universal serial bus (USB) and is electrically connected to an information processing device (for example, a personal computer or a mobile information processing terminal) to transmit and receive an input image and various kinds of information to and from the information processing device. The interface device 135 may be substituted by a communication unit including an antenna to transmit and receive wireless signals and a wireless communication interface device to transmit and receive the signals through a wireless communication line according to a predetermined communication protocol. The predetermined communication protocol is, for example, a wireless local area network (LAN) communication protocol. The communication unit may include a wired communication interface device to transmit and receive signals through a wired communication line according to, for example, a wired LAN communication protocol.

The storage device 140 includes memories such as a random-access memory (RAM) and a read-only memory (ROM); a fixed disk device such as a hard disk; or a portable memory such as a flexible disk or an optical disk. The storage device 140 stores, for example, computer programs, databases, and tables used for various processes performed by the media conveying apparatus 100. The computer programs may be installed in the storage device 140 from a computer-readable portable recording medium using, for example, a known setup program. The portable recording medium is, for example, a compact disc read-only memory (CD-ROM) or a digital versatile disc read-only memory (DVD-ROM).

The processing circuit 150 operates according to a program prestored in the storage device 140. The processing circuit 150 is, for example, a central processing unit (CPU). Alternatively, a digital signal processor (DSP), a large-scale integration (LSI), an application-specific integrated circuit (ASIC), a field-programmable gate array (FPGA), etc. may be used as the processing circuit 150.

The processing circuit 150 is connected to the operation device 105, the display device 106, the first media sensor 111, the second media sensor 117, the ultrasonic sensor 118, the third media sensor 121, the imaging device 122, the first motor 131, the second motor 132, the third motor 133, the interface device 135, the storage device 140, etc. and controls these components. The processing circuit 150 controls the driving of the motors described above and the imaging by the imaging device 122, according to the media signals received from the media sensors described above. The processing circuit 150 acquires an input image from the imaging device 122 and transmits the input image to the information processing device via the interface device 135. The processing circuit 150 determines whether the multi-feed of the medium has occurred based on the ultrasonic signal received from the ultrasonic sensor 118. The processing circuit 150 controls the motors to return the media to the media table 103 when it is determined that the multi-feed of the medium has occurred.

Figure 7:
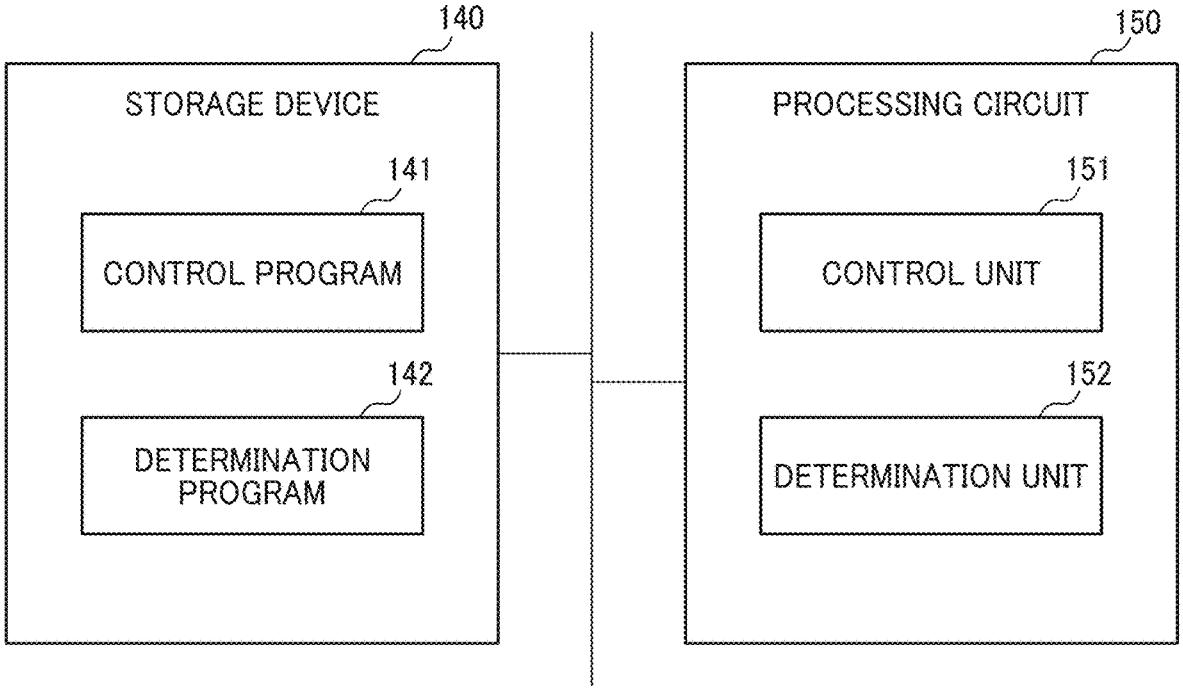
FIG. 7 is a schematic block diagram illustrating a configuration of a storage device and a processing circuit included in the media conveying apparatus of FIG. 1.

FIG. 7 is a schematic block diagram illustrating a configuration of the storage device 140 and the processing circuit 150.

As illustrated in FIG. 7, the storage device 140 stores, a control program 141, a determination program 142, etc. These programs are functional modules implemented by software operating on the processor. The processing circuit 150 reads the programs from the storage device 140 and operates according to the read programs. Thus, the processing circuit 150 functions as a control unit 151 and a determination unit 152.

Figure 8:
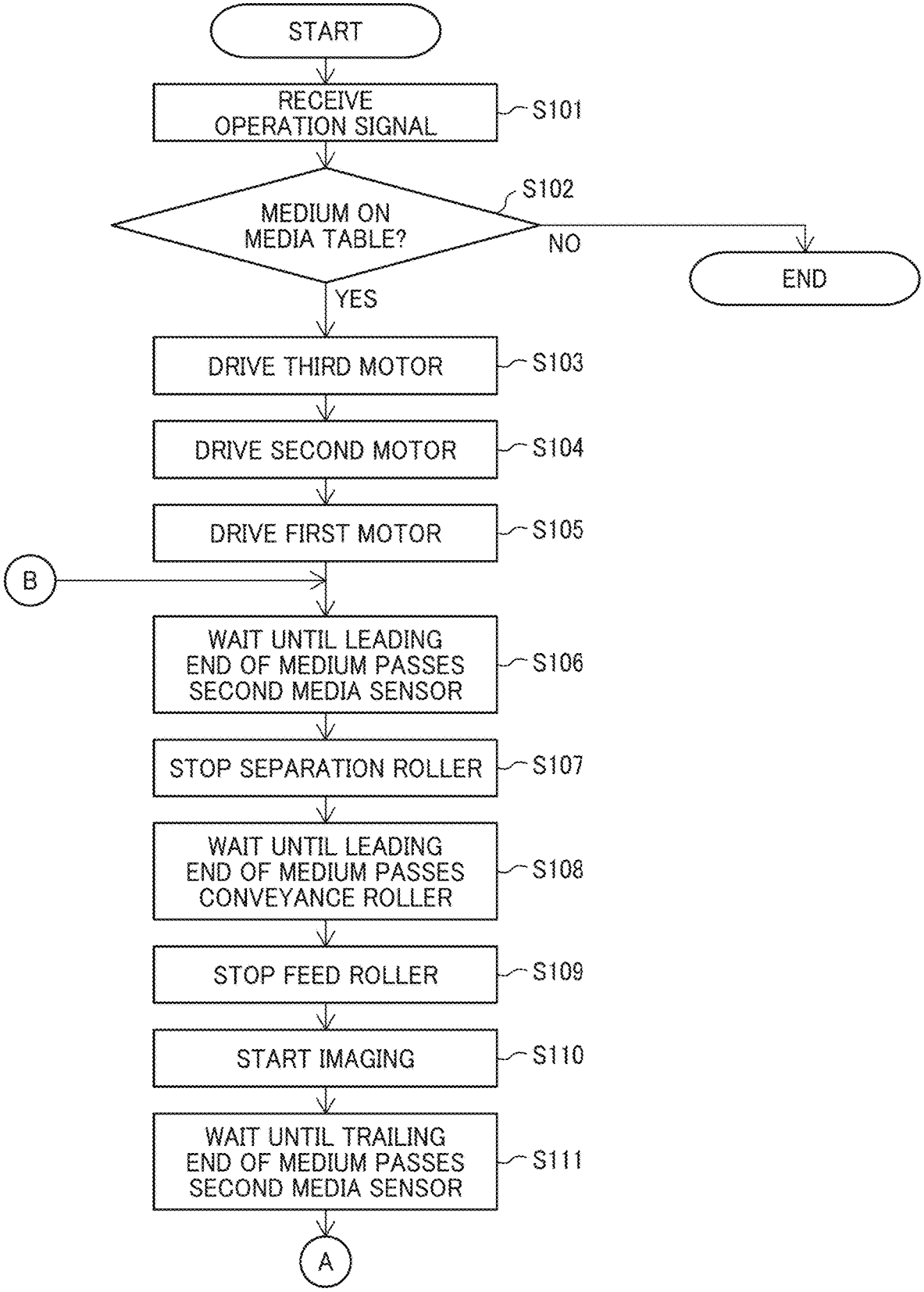
FIG. 8 is a flowchart of a media reading process.
Figure 9:
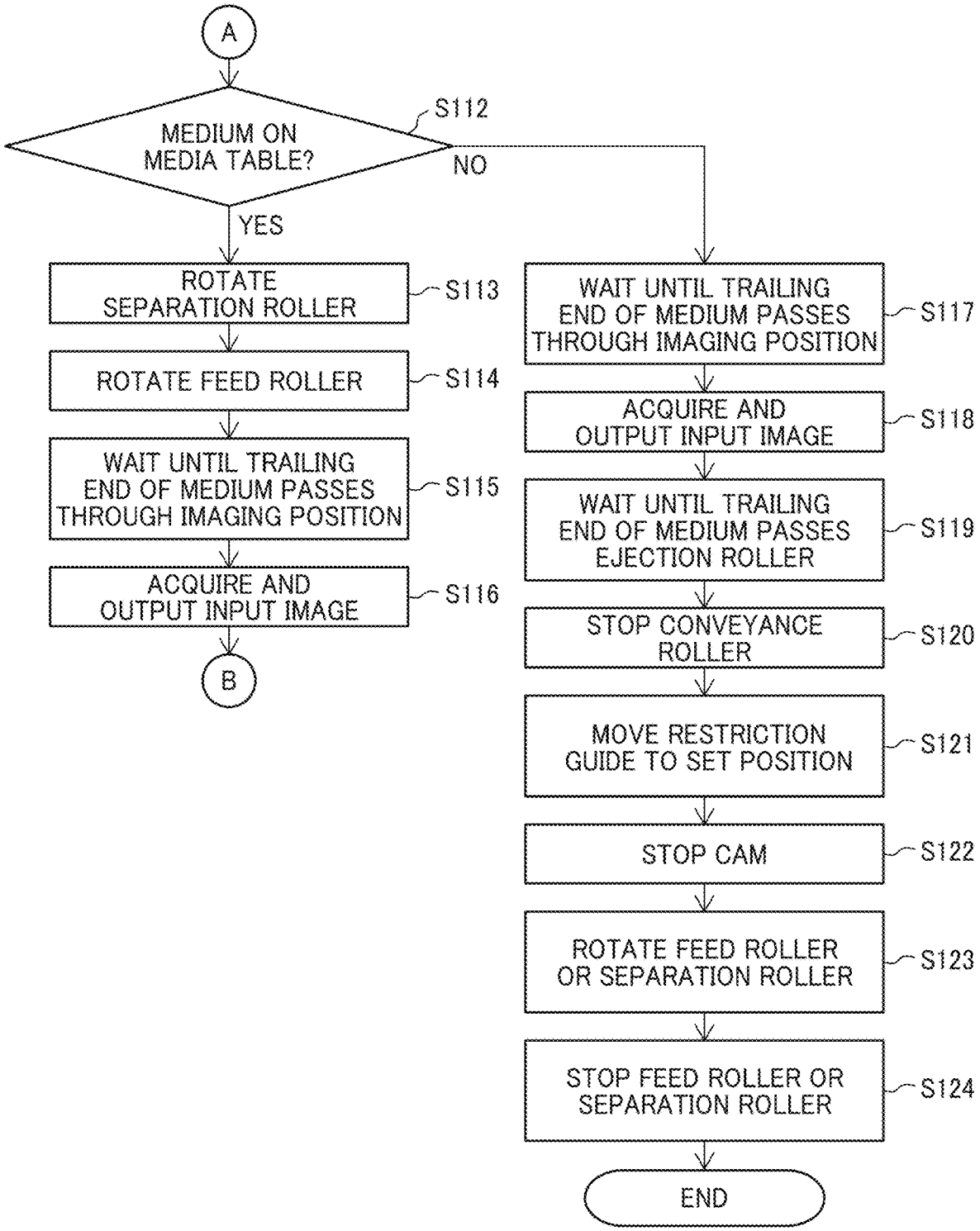
FIG. 9 is a continuation of the flowchart of FIG. 8.

FIG. 8 is a flowchart of a media reading process performed by the media conveying apparatus 100. FIG. 9 is a continuation of the flowchart of FIG. 8.

A description is given below of the media reading process performed by the media conveying apparatus 100, with reference to the flowchart of FIGS. 8 and 9. The sequence of operations described below is executed, for example, by the processing circuit 150 in cooperation with the components of the media conveying apparatus 100 based on the program prestored in the storage device 140.

In step S101, the control unit 151 waits until the control unit 151 receives an operation signal instructing the reading of media from the operation device 105 or the interface device 135. The operation signal is output when the user inputs an instruction to read media using the operation device 105 or the information processing device.

In step S102, the control unit 151 acquires the first media signal from the first media sensor 111 and determines whether a medium is placed on the media table 103 based on the acquired first media signal. When no medium is placed on the media table 103 (NO in step S102), the control unit 151 ends the series of steps.

By contrast, when a medium is placed on the media table 103 (YES in step S102), in step S103, the control unit 151 drives the third motor 133 first. The control unit 151 drives the third motor 133 to rotate the cam 113 in the direction indicated by arrow A11 in FIG. 3 to move the restriction guide 112 in the direction indicated by arrow A12 in FIG. 3, that is, from the set position to the released position. The control unit 151 drives the third motor 133 to rotate the conveyance roller 119, the first facing roller 120, the ejection roller 123, and/or the second facing roller 124 in the directions indicated by arrows A6, A7, A8, and/or A9, respectively, in FIG. 2.

In step S104, the control unit 151 drives the second motor 132 to rotate the separation roller 116 in the direction opposite to the feeding direction, that is, in the direction indicated by arrow A5 in FIG. 2.

In step S105, the control unit 151 drives the first motor 131 to rotate the feed roller 115 in the media feed direction, that is, in the direction indicated by arrow A4 in FIG. 2, to feed the medium.

Figure 10:
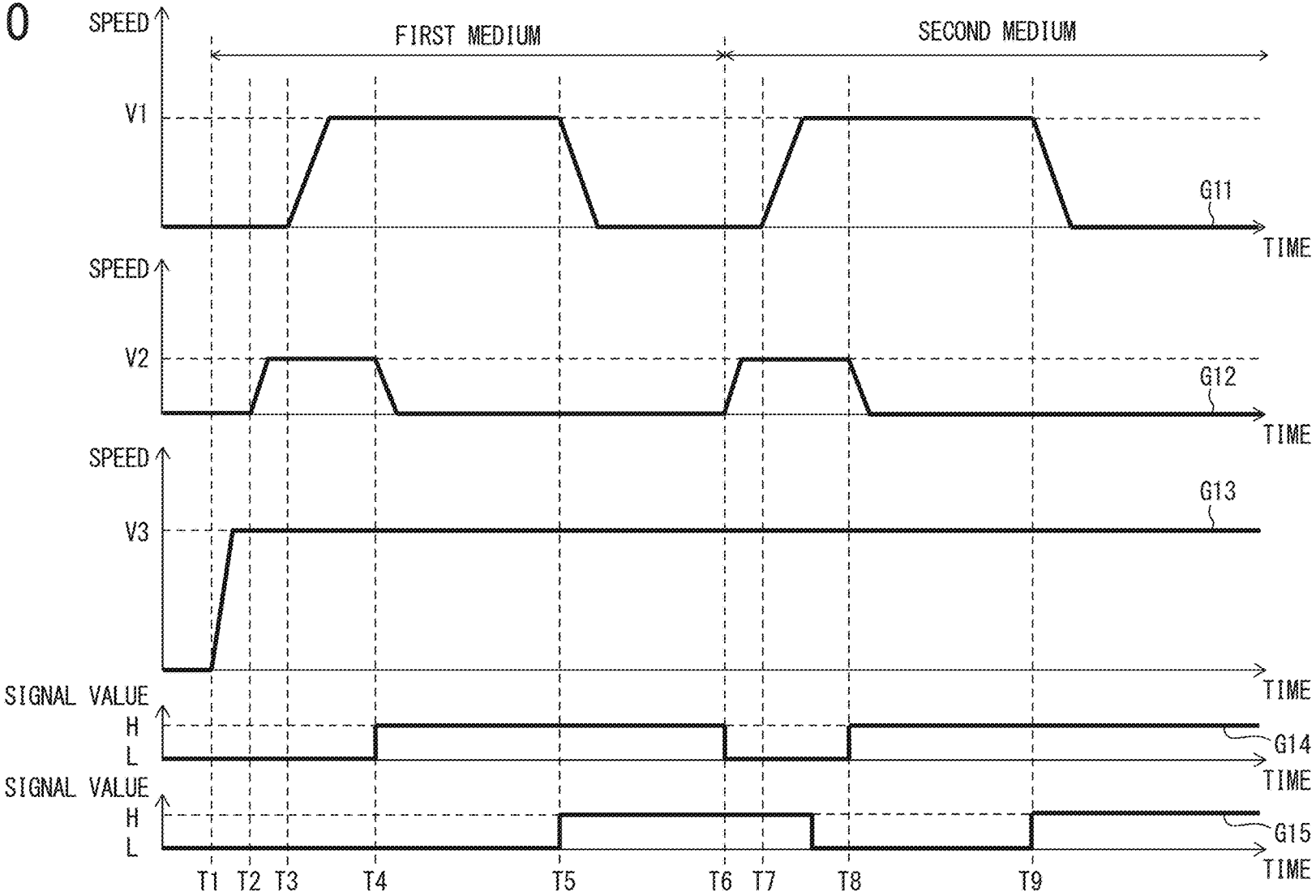
FIG. 10 is a graph illustrating changes in the speed of a feed roller and other rollers.

FIG. 10 is a graph illustrating changes in the speed of the feed roller 115, the separation roller 116, and the conveyance roller 119.

In FIG. 10, a graph G11 indicates a change in the speed of the feed roller 115, a graph G12 indicates a change in the speed of the separation roller 116, and a graph G13 indicates a change in the speed of the conveyance roller 119. Since the speeds of the first facing roller 120, the ejection roller 123, and the second facing roller 124 change like the speed of the conveyance roller 119, the change in the speed of the conveyance roller 119 will be described below as a representative example. The horizontal axis of each of the graphs G11 to G13 indicates time, whereas the vertical axis of each of the graphs G11 to G13 indicates speed.

A graph G14 indicates a change in the signal value of the second media sensor 117, whereas a graph G15 indicates a change in the signal value of the third media sensor 121. The horizontal axis of each of the graphs G14 and G15 indicates time, whereas the vertical axis of each of the graphs G14 and G15 indicates signal value. In the present embodiment, when no medium is present at the position of each sensor, the signal value of the corresponding signal indicates L. By contrast, when a medium is present at the position of each sensor, the signal value of the corresponding signal indicates H.

In FIG. 10, time T1 indicates the time to start feeding media. As described above, the control unit 151 starts driving the third motor 133, the second motor 132, and the first motor 131 in this order. Therefore, the conveyance roller 119, the separation roller 116, and the feed roller 115 sequentially start rotating at the times T1, T2, and T3, respectively. The speed V2 of the separation roller 116 (the moving speed of the outer circumferential surface of the separation roller 116) is set to be lower than the speed V1 of the feed roller 115 (the moving speed of the outer circumferential surface of the feed roller 115). The speed V3 of the conveyance roller 119 (the moving speed of the outer circumferential surface of the conveyance roller 119) is set to be higher than the speed V1 of the feed roller 115 (the moving speed of the outer circumferential surface of the feed roller 115).

The control unit 151 starts driving the third motor 133, the second motor 132, and the first motor 131 in this order. Therefore, when the restriction guide 112 moves from the set position and releases the medium from the restriction by the flap 114, that is, when the leading end of the media placed on the media table 103 contacts the separation roller 116 and the feed roller 115, the feed roller 115 and the separation roller 116 have been stopped. Then, the separation roller 116 starts rotating before the feed roller 115 starts rotating. Thus, as illustrated in FIG. 4, the media group M1 placed on the media table 103 contacts the separation roller 116 before entering the nip between the feed roller 115 and the separation roller 116. The separation roller 116 rotating in the direction opposite to the media feeding direction separates the leading ends of the media group M1 so that upper media are upstream from the lower media of the media group M1. This prevents multiple media from entering the nip between the feed roller 115 and the separation roller 116 when the feed roller 115 starts rotating, thus preventing the occurrence of multi-feed of the medium.

Since the separation roller 116 starts rotating before the feed roller 115 starts rotating, the separation roller 116 is prevented from being rotated by the rotation of the feed roller 115 before the separation roller 116 starts rotating, and thus the separation roller 116 can favorably separate the media.

Alternatively, the control unit 151 may execute the operation in step S104 before the operation in step S103 to operate the second motor 132 and then operate the third motor 133 at the start of feeding of media. In this case, when the restriction guide 112 moves from the set position and the leading end of the media contacts the separation roller 116 and the feed roller 115, the separation roller 116 rotates while the feed roller 115 is stopped. Therefore, in this case, the media conveying apparatus 100 controls the first motor 131, the second motor 132, and the third motor 133 to rotate the feed roller 115 after the separation roller 116 in rotating state contacts the media. The separation roller 116 rotating in the direction opposite to the media feeding direction separates the leading ends of the media group M1 so that upper media are upstream from the lower media of the media group M1. This prevents multiple media from entering the nip between the feed roller 115 and the separation roller 116 together when the feed roller 115 starts rotating, thus preventing the occurrence of multi-feed of the medium.

Since the separation roller 116 starts rotating before the feed roller 115 starts rotating, the separation roller 116 is prevented from being rotated by the rotation of the feed roller 115 before the separation roller 116 starts rotating, and thus the separation roller 116 can favorably separate the media.

As described above, at the start of feeding of media, the control unit 151 controls the first motor 131, the second motor 132, and the third motor 133 to rotate the feed roller 115 after the separation roller 116 in rotating state contacts the media. In particular, at the start of feeding of media, the control unit 151 operates the second motor 132 and the third motor 133 and then operates the first motor 131. Accordingly, the control unit 151 can prevent the occurrence of multi-feed of the medium at the start of feeding of media.

As described above, the restriction guide 112 is moved by the rotation of the cam 113. The restriction guide 112 and the flap 114 are engaged with each other to restrict the contact of the media with the feed roller 115 and the separation roller 116. Therefore, it takes some time from when the third motor 133 is driven to when the restriction guide 112 and the flap 114 move and the media contact the feed roller 115 and the separation roller 116. The control unit 151 can shorten the time taken to feed the media by driving the third motor 133 to start the movement of the restriction guide 112 and the flap 114 before driving the first motor 131 to start the rotation of the feed roller 115.

The control unit 151 may wait for a first predetermined time from when the control unit 151 drives the third motor 133 in step S103 to when the control unit 151 drives the first motor 131 in step S105. The first predetermined time is set to a time from when the third motor 133 is driven to when the leading ends of the media restricted by the flap 114 contact the separation roller 116 rotating in the direction opposite to the media feeding direction. This ensures that the separation force is applied from the separation roller 116 to the media group before the feeding force is applied from the feed roller 115. Accordingly, the control unit 151 can reliably prevent the occurrence of the multi-feed of the medium.

As described above, the shaft 116*a* of the separation roller 116 is provided with the torque limiter 116*c*. Depending on the position of the torque limiter 116*c*, a clearance (backlash) may be present between the shaft 116*a* and the outer circumferential surface 116*b* of the separation roller 116, where the driving force is not transmitted. Therefore, depending on the position of the torque limiter 116*c*, it may take some time until the driving force is transmitted from the second motor 132 to the separation roller 116. The control unit 151 can remove the clearance (backlash) between the shaft 116*a* and the separation roller 116 by driving the second motor 132 to start the rotation of the separation roller 116 before driving the first motor 131 to start the rotation of the feed roller 115. This ensures that the separation force is applied from the separation roller 116 to the media group before the feeding force is applied from the feed roller 115. Accordingly, the control unit 151 can prevent the occurrence of the multi-feed of the medium.

The control unit 151 may wait for a second predetermined time from when the control unit 151 drives the second motor 132 in step S104 to when the control unit 151 drives the first motor 131 in step S105. The second predetermined time is set to a time from when the second motor 132 is driven to when the separation roller 116 is reliably rotated. Accordingly, the control unit 151 can reliably prevent the occurrence of multi-feed of the medium.

Referring back to FIG. 8, in step S106, the control unit 151 waits until the leading end of the conveyed medium passes the position of the second media sensor 117. The control unit 151 periodically acquires the second media signal from the second media sensor 117 and determines that the leading end of the medium has passed the position of the second media sensor 117 when the signal value of the second media signal changes from a value indicating the absence of a medium to a value indicating the presence of a medium.

In step S107, the control unit 151 controls the second motor 132 to stop the separation roller 116.

In FIG. 10, time T4 indicates the time when the signal value of the second media signal changes from L to H, that is, the time when the leading end of the medium passes the position of the second media sensor 117. As illustrated in FIG. 10, when the leading end of the medium passes the position of the second media sensor 117, the rotation of the separation roller 116 is stopped. When the leading end of the medium passes the position of the second media sensor 117, the leading end of the medium has already passed through the nip between the feed roller 115 and the separation roller 116. In short, the separation of the medium has been completed. Accordingly, by stopping the separation roller 116, the control unit 151 can reduce the power consumption and the temperature of the media conveying apparatus 100 while separating the medium as appropriate.

Referring back to FIG. 8, in step S108, the control unit 151 waits until the leading end of the conveyed medium passes the position of the conveyance roller 119. The control unit 151 periodically acquires the third media signal from the third media sensor 121 and determines that the leading end of the medium has passed the position of the third media sensor 121 when the signal value of the third media signal changes from a value indicating the absence of a medium to a value indicating the presence of a medium. The control unit 151 determines that the leading end of the medium has passed the position of the conveyance roller 119 when the leading end of the medium has passed the position of the third media sensor 121.

In step S109, the control unit 151 controls the first motor 131 to stop the feed roller 115.

In FIG. 10, time T5 indicates the time when the signal value of the third media signal changes from L to H, that is, the time when the leading end of the medium passes the position of the third media sensor 121. As illustrated in FIG. 10, after the leading end of the medium passes the position of the third media sensor 121, the control unit 151 stops the feed roller 115. As a result, the medium is thereafter conveyed by the conveyance roller 119, whereas the feed roller 115 is rotated by the medium being conveyed. By stopping the feed roller 115, the control unit 151 can prevent the medium from being jammed due to the medium being pushed by the feed roller 115 and bent between the feed roller 115 and the conveyance roller 119.

Referring back to FIG. 8, in step S110, the control unit 151 causes the imaging device 122 to start imaging the medium.

In step S111, the control unit 151 waits until the trailing end of the conveyed medium passes the position of the second media sensor 117. The control unit 151 periodically acquires the second media signal from the second media sensor 117 and determines that the trailing end of the medium has passed the position of the second media sensor 117 when the signal value of the second media signal changes from a value indicating the presence of a medium to a value indicating the absence of a medium.

In step S112, the control unit 151 determines whether a medium remains on the media table 103 based on the first media signal received from the first media sensor 111.

When a medium remains on the media table 103 (YES in step S112), in step S113, the control unit 151 controls the second motor 132 to rotate the separation roller 116 again in the direction opposite to the media feeding direction, that is, in the direction indicated by arrow A5 in FIG. 2.

In step S114, the control unit 151 controls the first motor 131 to rotate the feed roller 115 again in the media feeding direction, that is, in the direction indicated by arrow A4 in FIG. 2, to feed the following medium.

In FIG. 10, time T6 indicates the time when the signal value of the second media signal changes from H to L, that is, the time when the trailing end of the medium passes the position of the second media sensor 117. As described above, the control unit 151 starts driving the second motor 132 and the first motor 131 in this order. Therefore, the separation roller 116 and the feed roller 115 sequentially start rotating at the times T6 and T7, respectively.

Thus, the control unit 151 can cause the separation roller 116 to apply the separation force to the media group remaining on the media table 103 before the feeding force is applied by the feed roller 115. As a result, before the leading ends of the media group remaining on the media table 103 enter the nip between the feed roller 115 and the separation roller 116, the separation roller 116 rotating in the direction opposite to the media feeding direction separates the leading ends of the media group so that the upper media are upstream from the lower media of the media group. This prevents multiple media from entering the nip between the feed roller 115 and the separation roller 116 when the feed roller 115 starts rotating, thus preventing the occurrence of multi-feed of the medium.

Since the separation roller 116 starts rotating before the feed roller 115 starts rotating, the separation roller 116 is prevented from being rotated by the rotation of the feed roller 115 before the separation roller 116 starts rotating, and thus the separation roller 116 can favorably separate the media.

As described above, at the start of feeding of the second and following media of the media set on the restriction guide 112, the control unit 151 controls the first motor 131 and the second motor 132 to rotate the separation roller 116 and then rotate the feed roller 115. Accordingly, the control unit 151 can prevent the occurrence of multi-feed of the medium at the start of feeding of the second and following media.

Referring back to FIG. 9, in step S115, the control unit 151 waits until the trailing end of the preceding medium passes through the imaging position in the imaging device 122. The control unit 151 periodically acquires the third media signal from the third media sensor 121 and determines that the trailing end of the preceding medium has passed the position of the third media sensor 121 when the signal value of the third media signal changes from a value indicating the presence of a medium to a value indicating the absence of a medium. The control unit 151 determines that the trailing end of the preceding medium has passed through the imaging position when a third predetermined time has elapsed since the trailing end of the preceding medium has passed the position of the third media sensor 121. The third predetermined time is set to a value obtained by adding a margin to the time taken for media to move from the position of the third media sensor 121 to the imaging position.

In step S116, the control unit 151 acquires an input image from the imaging device 122 and transmits (i.e., outputs) the acquired input image to the information processing device via the interface device 135.

The control unit 151 then returns to step S106 and repeats the operations from step S106 onward for the following medium. In this case, in step S106, the control unit 151 waits until the leading end of the following medium passes the position of the second media sensor 117 (at the time T8 in FIG. 10). In step S107, the control unit 151 controls the second motor 132 to stop the separation roller 116. In step S108, the control unit 151 waits until the leading end of the following medium passes the position of the conveyance roller 119 (at the time T9 in FIG. 10). In step S109, the control unit 151 controls the first motor 131 to stop the feed roller 115.

By contrast, when no medium remains on the media table 103 (NO in step S112), in step S117, the control unit 151 waits until the trailing end of the conveyed medium passes through the imaging position in the imaging device 122 as in the operation in step S115.

In step S118, the control unit 151 acquires an input image from the imaging device 122 and transmits (i.e., outputs) the acquired input image to the information processing device via the interface device 135.

In step S119, the control unit 151 waits until the trailing end of the conveyed medium passes the position of the ejection roller 123. The control unit 151 determines that the trailing end of the medium has passed the position of the ejection roller 123 when a fourth predetermined time has elapsed since the trailing end of the medium has passed the position of the third media sensor 121. The fourth predetermined time is set to a value obtained by adding a margin to the time taken for media to move from the position of the third media sensor 121 to the position of the ejection roller 123.

In step S120, the control unit 151 controls the third motor 133 to stop the conveyance roller 119, the first facing roller 120, the ejection roller 123, and/or the second facing roller 124.

In step S121, the control unit 151 controls the third motor 133 to rotate the cam 113 in the direction opposite to the direction indicated by arrow A11 in FIG. 3 to move the restriction guide 112 in the direction opposite to the direction indicated by arrow A12 in FIG. 3, that is, from the released position to the set position. As a result, the restriction guide 112 is located at the set position, and the flap 114 is engaged with the restriction guide 112 at the set position and located at a position (illustrated in FIG. 3) to prevent the media from entering the nip between the feed roller 115 and the separation roller 116. At this time, the conveyance roller 119, the first facing roller 120, the ejection roller 123, and/or the second facing roller 124 rotate in the directions opposite to the directions indicated by arrows A6, A7, A8, and A9, respectively, in FIG. 2. However, no problem occurs because no medium is present in the media conveyance passage.

In step S122, the control unit 151 controls the third motor 133 to stop the cam 113.

In step S123, the control unit 151 controls the first motor 131 or the second motor 132 to rotate the feed roller 115 or the separation roller 116. The control unit 151 controls the first motor 131 or the second motor 132 to rotate one or both of the feed roller 115 and the separation roller 116 in the media feeding direction. By rotating one of the feed roller 115 and the separation roller 116, the control unit 151 can cause the other roller to be rotated by the rotation of the one of the feed roller 115 and the separation roller 116.

In other words, when no medium is fed, the control unit 151 controls the first motor 131 or the second motor 132 to rotate the feed roller 115 or the separation roller 116 while the restriction guide 112 is located at the set position. The control unit 151 rotates the feed roller 115 or the separation roller 116 to move the dust adhering to the feed roller 115 or the separation roller 116. As the feed roller 115 and the separation roller 116 rotate, the dust adhering to the feed roller 115 or the separation roller 116 from the fed medium falls from the feed roller 115 or the separation roller 116 and is contained in the container 134. Further, the rotation of the feed roller 115 and the separation roller 116 diffuses the dust adhering to the rollers or the dust aggregated around the rollers. Accordingly, the contact area between the medium and the rubber portion of each roller is secured, allowing the media conveying apparatus 100 to prevent a decrease in the forces for feeding and separating media.

In step S124, the control unit 151 controls the first motor 131 or the second motor 132 to stop the feed roller 115 or the separation roller 116. Thus, the control unit 151 ends the series of steps.

The operations in steps S103, S104, and S105 may be executed in any order. The operations in steps S113 and S114 may be executed in any order. The operations in steps S123 and S124 may be executed at any time when no medium is fed. Alternatively, the operations in steps S123 and S124 may be omitted.

Figure 11:
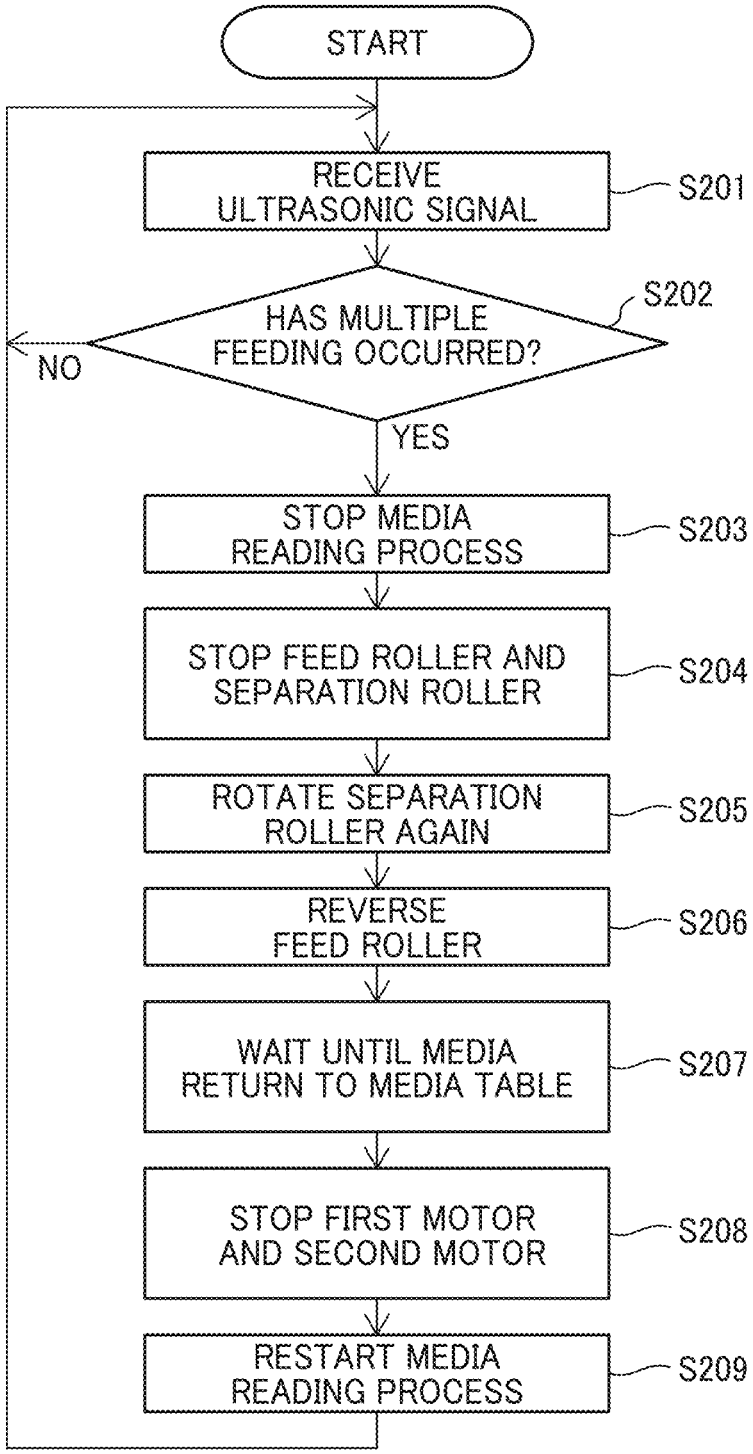
FIG. 11 is a flowchart of a multi-feed determination process.

FIG. 11 is a flowchart of a multi-feed determination process performed by the media conveying apparatus 100.

A description is given below of the multi-feed determination process performed by the media conveying apparatus 100, with reference to the flowchart of FIG. 11. The sequence of operations described below is executed, for example, by the processing circuit 150 in cooperation with the components of the media conveying apparatus 100 based on the program prestored in the storage device 140. The sequence of operations illustrated in FIG. 11 is periodically executed during conveyance of media.

In step S201, the determination unit 152 acquires the ultrasonic signal from the ultrasonic sensor 118.

In step S202, the determination unit 152 determines whether the multi-feed of the medium has occurred based on the acquired ultrasonic signal. When the signal value of the ultrasonic signal is equal to or greater than a multi-feed threshold, the determination unit 152 determines that the multi-feed of the medium has not occurred. By contrast, when the signal value of the ultrasonic signal is less than the multi-feed threshold, the determination unit 152 determines that the multi-feed of the medium has occurred. The multi-feed threshold is set to a value between the signal value of the ultrasonic signal when a single sheet is conveyed and the signal value of the ultrasonic signal when the multi-feed of sheets occurs. When the determination unit 152 determines that the multi-feed of the medium has not occurred (NO in step S202), the determination unit 152 returns to step S201 and repeats the operations in steps S201 to S202.

By contrast, when the determination unit 152 determines that the multi-feed of the medium has occurred (YES in step S202), in step S203, the control unit 151 temporarily stops the media reading process.

In step S204, the control unit 151 controls the first motor 131 and the second motor 132 to stop the feed roller 115 and the separation roller 116. The determination unit 152 determines that the multi-feed of the medium has occurred when the leading ends of the multi-fed media pass the position of the ultrasonic sensor 118. At this time, the leading ends of the media have not reached the position of the conveyance roller 119. The control unit 151 controls the third motor 133 to continue to rotate the conveyance roller 119, the first facing roller 120, the ejection roller 123, and/or the second facing roller 124. Accordingly, the control unit 151 can continue to convey the medium that has been fed before the multi-fed media.

In step S205, the control unit 151 controls the second motor 132 to rotate the separation roller 116 again in the direction opposite to the media feeding direction, that is, in the direction indicated by arrow A5 in FIG. 2.

In step S206, the control unit 151 controls (reverses) the first motor 131 to rotate the feed roller 115 in the direction opposite to the media feeding direction, that is, in the direction opposite to the direction indicated by arrow A4 in FIG. 2, to return the multi-fed media to the media table 103. The control unit 151 controls the first motor 131 and the second motor 132 to set the circumferential speed of the shaft 115*a* serving as the rotary shaft of the feed roller 115 to be higher than the circumferential speed of the outer circumferential surface 115*b* of the feed roller 115 that is rotated by the rotation of the separation roller 116.

In this way, when the determination unit 152 determines that the multi-feed of the medium has occurred, the control unit 151 controls the first motor 131 and the second motor 132 to return the media to the media table 103. When returning the media to the media table 103, the control unit 151 controls the first motor 131 and the second motor 132 to rotate the separation roller 116 and then rotate the feed roller 115. When returning the media to the media table 103, the control unit 151 controls the first motor 131 and the second motor 132 to set the circumferential speed of the shaft 115*a* serving as the rotary shaft of the feed roller 115 to be higher than the circumferential speed of the outer circumferential surface 115*b* of the feed roller 115 that is rotated by the rotation of the separation roller 116.

Figure 12:
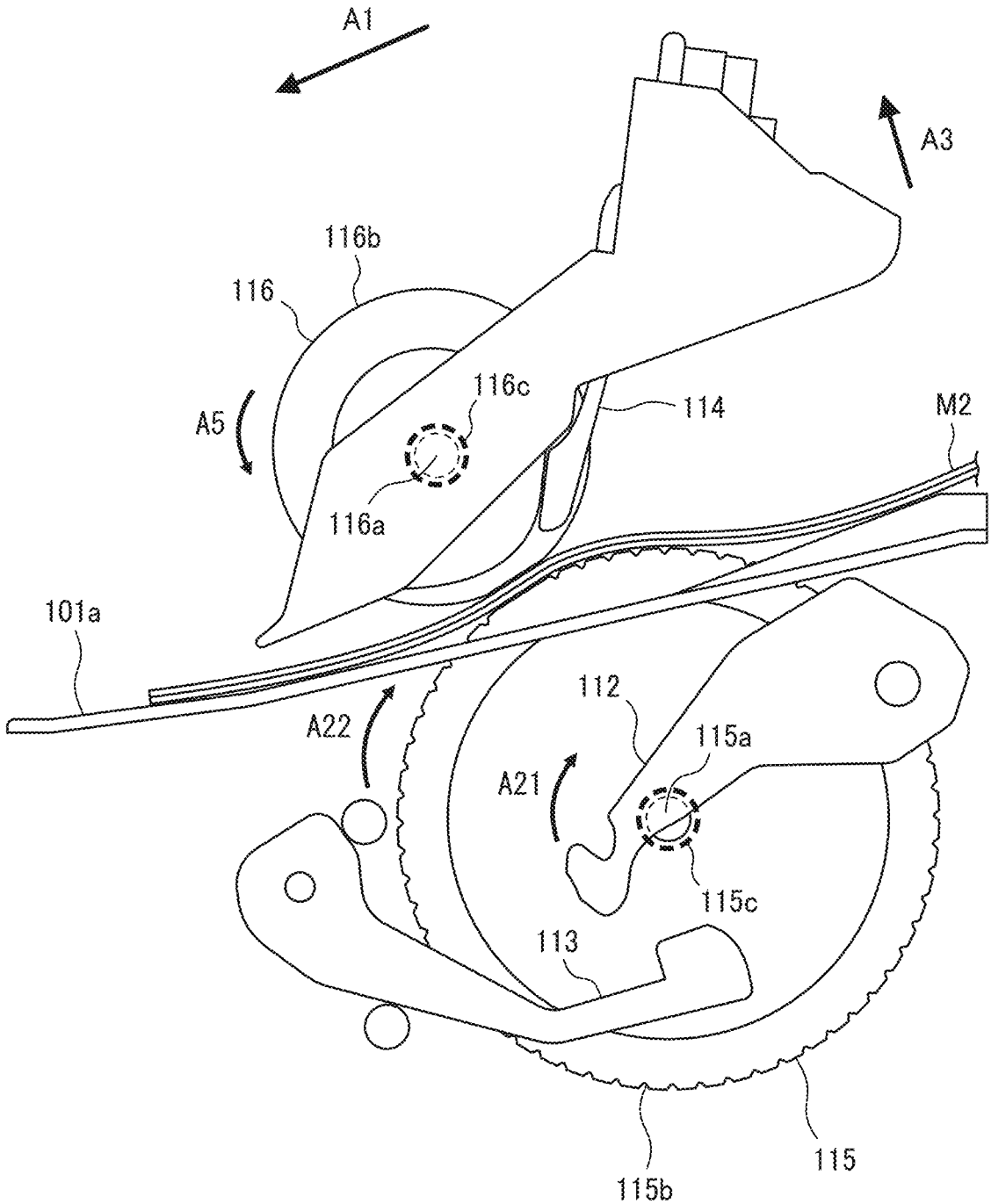
FIG. 12 is a schematic diagram illustrating the operation of returning media to a media table.

FIG. 12 is a schematic diagram illustrating the operation of returning media M2, which have been multi-fed, to the media table 103. Specifically, FIG. 12 is a side view of the feed roller 115 and the separation roller 116 when the multi-feed occurs.

As described above, the limit value of the torque limiter 116*c* located on the shaft 116*a* of the separation roller 116 is set to transmit the rotational force through the torque limiter 116*c* when multiple media are conveyed. When the shaft 115*a* serving as the rotary shaft of the feed roller 115 is rotated in the direction indicated by arrow A21 opposite to the media feeding direction, the outer circumferential surface 115*b* of the feed roller 115 is not rotated by the driving force from the first motor 131 due to the operation of the one-way clutch 115*c*. The outer circumferential surface 115*b* of the feed roller 115 is rotated in the direction indicated by arrow A22 opposite to the media feeding direction by the rotation of the separation roller 116.

The shaft 115*a* of the feed roller 115 rotates at a circumferential speed higher than the circumferential speed of the outer circumferential surface 115*b* of the feed roller 115 that is rotated by the rotation of the separation roller 116. Thus, the outer circumferential surface 115*b* of the feed roller 115 is rotated by the rotation of the outer circumferential surface 116*b* of the separation roller 116 without being hindered by the one-way clutch 115*c*. In this way, the feed roller 115 is rotated in the direction indicated by arrow A22 opposite to the media feed direction by the rotation of the separation roller 116. The separation roller 116 rotates in the direction indicated by arrow A5 opposite to the media feeding direction without receiving load from the feed roller 115.

Accordingly, when the multiple media M2 are multi-fed between the separation roller 116 and feed roller 115, the media conveying apparatus 100 can return all of the multiple media M2 to the media table 103 by reversing the first motor 131.

As described above, the shaft 116*a* of the separation roller 116 is provided with the torque limiter 116*c*. Depending on the position of the torque limiter 116*c*, the backlash may be present between the shaft 116*a* and the separation roller 116, where the driving force is not transmitted. Therefore, if the shaft 115*a* of the feed roller 115 is rotated before the separation roller 116, the shaft 115*a* of the feed roller 115 may start rotating while the separation roller 116 is not locked. In this case, the media are not sufficiently fixed by the separation roller 116 and are unstable. As a result, the lowermost medium in contact with the feed roller 115 may be wrinkled when the shaft 115*a* of the feed roller 115 starts rotating. Further, the separation roller 116 starts rotating while the outer circumferential surface 115*b* of the feed roller 115 is not locked. The media are not sufficiently fixed by the outer circumferential surface 115*b* of the feed roller 115 and are unstable. As a result, the uppermost medium in contact with the separation roller 116 may be wrinkled when the separation roller 116 starts rotating.

The media conveying apparatus 100 rotates the separation roller 116 and then rotates the shaft 115*a* of the feed roller 115. Thus, when the separation roller 116 starts rotating, the outer circumferential surface 115*b* of the feed roller 115 is supported by the shaft 115*a* of the feed roller 115, and the media are stabled by the feed roller 115. Accordingly, the media conveying apparatus 100 can prevent the uppermost medium in contact with the separation roller 116 from being wrinkled. When the shaft 115*a* of the feed roller 115 starts rotating, the backlash is absent between the separation roller 116 and the shaft 116*a*, and the media are stabled by the separation roller 116. Accordingly, the media conveying apparatus 100 can prevent the lowermost medium in contact with the feed roller 115 from being wrinkled.

Referring back to FIG. 11, the control unit 151 may wait for a fifth predetermined time from when the control unit 151 rotates the separation roller 116 again in step S205 to when the control unit 151 reverses the feed roller 115 in step S206. The fifth predetermined time is set to a time during which the separation roller 116 rotates by the amount of the backlash between the separation roller 116 and the shaft 116*a*. Since the control unit 151 can start rotating the shaft 115*a* of the feed roller 115 after the backlash between the separation roller 116 and the shaft 116*a* is reliably eliminated, the control unit 151 can reliably prevent the medium from being wrinkled.

In step S207, the control unit 151 waits until the media returns to the media table 103. The control unit 151 periodically acquires the second media signal from the second media sensor 117 and determines that the downstream ends of media conveyed in the opposite direction to the media conveyance direction A1 have passed the position of the second media sensor 117 when the signal value of the second media signal changes from a value indicating the presence of a medium to a value indicating the absence of a medium. The control unit 151 determines that the media have returned to the media table 103 when a sixth predetermined time has elapsed since the downstream ends of the media have passed the position of the second media sensor 117. The sixth predetermined time is set to a value obtained by adding a margin to the time taken for the media conveyed in the opposite direction to the media conveyance direction A1 to move from the position of the second media sensor 117 to the upstream end of the nip between the feed roller 115 and the separation roller 116.

In step S208, the control unit 151 controls the first motor 131 and the second motor 132 to stop the feed roller 115 and the separation roller 116.

In step S209, the control unit 151 restarts the media reading process. Since the conveyance roller 119, the first facing roller 120, the ejection roller 123, and/or the second facing roller 124 have already been rotated, the control unit 151 restarts the media reading process from the operation in step S104 of FIG. 8. The control unit 151 then returns to step S201 and repeats the operations in steps S201 to S209.

The feed roller 115 may not include the one-way clutch 115*c*. In this case, the outer circumferential surface 115*b* may be rotated by the rotation of the shaft 115*a*. In this case, in step S205, the control unit 151 controls the second motor 132 to rotate the separation roller 116 again in the direction opposite to the media feeding direction. In step S206, the control unit 151 controls the first motor 131 to rotate the feed roller 115 in the direction opposite to the media feeding direction. In other words, when returning the media to the media table 103, the control unit 151 controls the first motor 131 and the second motor 132 such that the feed roller 115 rotates after the separation roller 116 rotates. When returning the media to the media table 103, the control unit 151 controls the first motor 131 and the second motor 132 to set the moving speed of the outer circumferential surface 115*b* of the feed roller 115 to be higher than the moving speed of the outer circumferential surface 116*b* of the separation roller 116.

In this case, when the multiple media M2 are multi-fed between the separation roller 116 and feed roller 115, the media conveying apparatus 100 can return all of the multiple media M2 to the media table 103 by reversing the first motor 131.

When the multi-feed of the medium has occurred, the lowermost medium in contact with the feed roller 115 is fed together with one or more media on top of the lowermost medium. The gravity of the one or media on top of the lowermost medium is applied to the lowermost medium in contact with the feed roller 115. Therefore, if the feed roller 115 is rotated before the separation roller 116 is rotated, a downward force is applied to the lowermost medium due to the gravity of the one or more media on top of the lowermost medium while a force toward upstream direction is applied to the lowermost medium by the feed roller 115. As a result, a force is applied to the lowermost medium such that the medium is twisted, and thus the lowermost medium may be wrinkled.

The media conveying apparatus 100 rotates the separation roller 116 and then rotates the feed roller 115. No medium is present on top of the uppermost medium in contact with the separation roller 116. Therefore, when the separation roller 116 is rotated before the feed roller 115 is rotated, only force toward upstream direction is applied to the medium in contact with the separation roller 116 by the separation roller 116, thus reducing the possibility of wrinkles occurring on the medium in contact with the separation roller 116. By rotating the separation roller 116 and then rotating the feed roller 115, the media conveying apparatus 100 can prevent the medium from being wrinkled.

The control unit 151 sets the moving speed of the outer circumferential surface 115*b* of the feed roller 115 to be higher than the moving speed of the outer circumferential surface 116*b* of the separation roller 116. Thus, the control unit 151 can cause the lowermost medium in contact with the feed roller 115 to catch up with the uppermost medium in contact with the separation roller 116. Accordingly, the control unit 151 can return the multi-fed media to the media table 103 at once and complete the recovery of the media early.

The control unit 151 may control the first motor 131 and the second motor 132 such that the amount of rotation of the separation roller 116 (the amount of movement of the outer circumferential surface 116*b*) is greater than the amount of rotation of the feed roller 115 (the amount of movement of the outer circumferential surface 115*b*). By increasing the amount of rotation of the separation roller 116, the control unit 151 can reliably return the upper medium, which has been fed together with the medium to be fed, to the media table 103. By decreasing the amount of rotation of the feed roller 115, the control unit 151 can prevent the lower medium from being wrinkled as a result of the medium being excessively returned.

Alternatively, the media conveying apparatus 100 may not execute the multi-feed determination process.

As described above in detail, in the media conveying apparatus 100, the first motor 131 for driving the feed roller 115, the second motor 132 for driving the separation roller 116, and the third motor 133 for driving the restriction guide 112 are separately located. In the media conveying apparatus 100, at the start of feeding of media, the first motor 131, the second motor 132, and the third motor 133 are controlled to rotate the feed roller 115 after the separation roller 116 in rotating state contacts the media. Such a configuration allows the separation roller 116 to favorably separate the leading ends of the media group placed on the media table 103, and thus the media conveying apparatus 100 can favorably separate the media.

In the media conveying apparatus 100, the first motor 131 for driving the feed roller 115 and the second motor 132 for driving the separation roller 116 are separately located. When returning media to the media table 103 when multi-feed of the medium has occurred, the media conveying apparatus 100 controls the first motor 131 and the second motor 132 to rotate the separation roller 116 and then rotate the shaft 115*a* of the feed roller 115. Such a configuration allows the media conveying apparatus 100 to stably return the multi-fed media to the media table 103 and appropriately recover the media when multi-feed of the medium has occurred.

In addition, the media conveying apparatus 100 can stably separate the media and stably return the multi-fed media to the media table 103, regardless of the number of media conveyed together or the type of media conveyed. Further, the media conveying apparatus 100 can prevent the media from being jammed when returning the multi-fed media to the media table 103.

Figure 13:
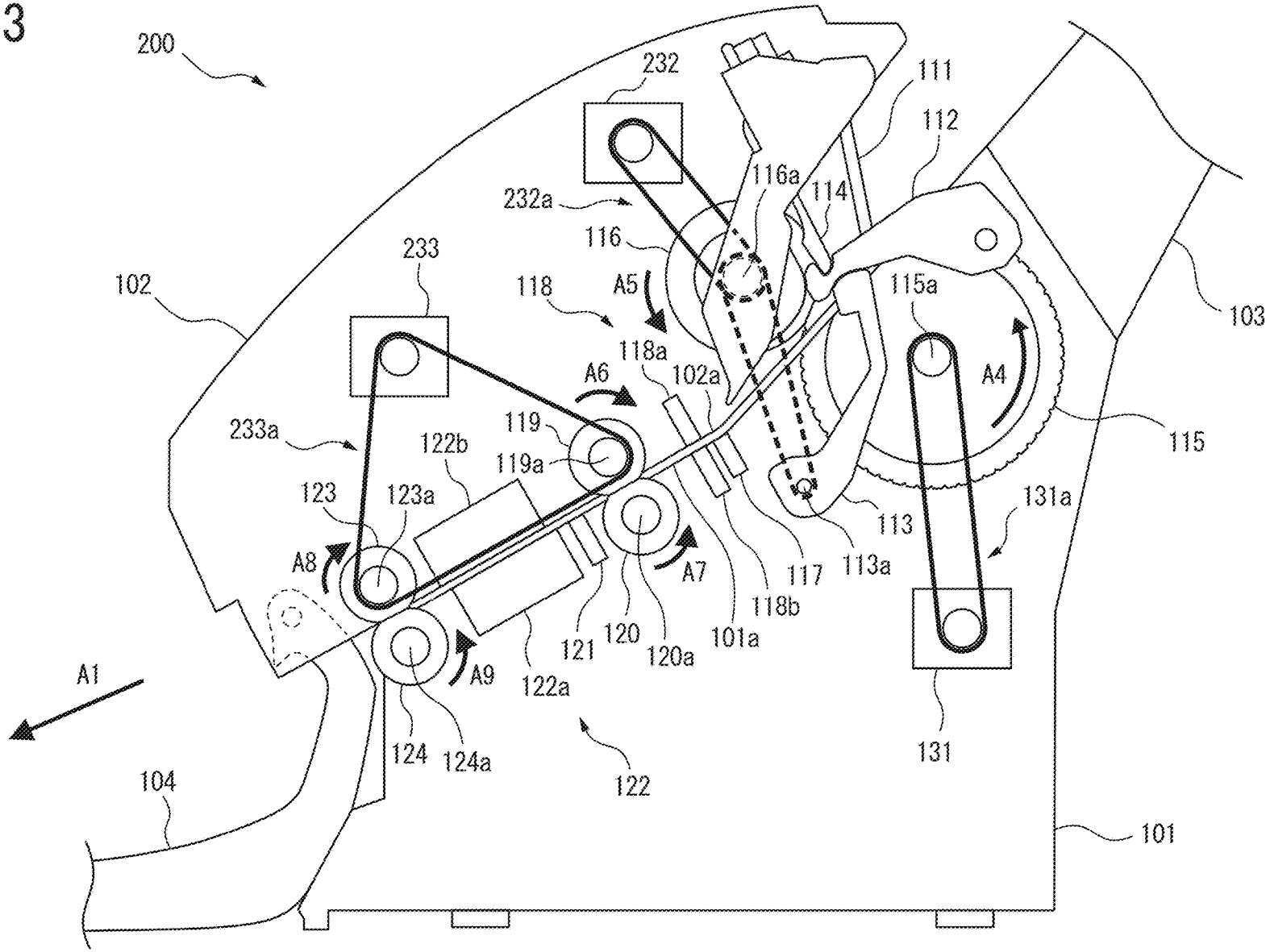
FIG. 13 is a diagram illustrating a conveyance passage inside a media conveying apparatus according to another embodiment of the present disclosure.

FIG. 13 is a diagram illustrating a conveyance passage inside a media conveying apparatus 200 according to another embodiment of the present disclosure.

The media conveying apparatus 200 includes the components included in the media conveying apparatus 100. However, the media conveying apparatus 200 includes a second motor 232, a third motor 233, a second transmission assembly 232*a*, and a third transmission assembly 233*a* instead of the second motor 132, the third motor 133, the second transmission assembly 132*a*, and the third transmission assembly 133*a*.

The second motor 232 and the second transmission assembly 232*a* have substantially the same configurations as the second motor 132 and the second transmission assembly 132*a*, respectively. However, the second motor 232 is coupled to the separation roller 116 and the cam 113 via the second transmission assembly 232*a* and drives the separation roller 116 and the cam 113. The second motor 232 generates a driving force for driving the separation roller 116 and the cam 113 according to control signals from the processing circuit 150. The second transmission assembly 232*a* includes one or more pulleys, belts, and gears between the second motor 232, the shaft 116*a* serving as the rotary shaft of the separation roller 116, and the rotary shaft 113*a* of the cam 113. In particular, one or more gears are located between the shaft 116*a* of the separation roller 116 and the rotary shaft 113*a* of the cam 113 to change the direction of rotation of the cam 113 from the direction of rotation of the separation roller 116. The second transmission assembly 232*a* transmits the driving force generated by the second motor 232 to the separation roller 116 and the cam 113. With this configuration, the second motor 232 rotates the separation roller 116 and causes the separation roller 116 to separate, feed, and convey media. The second motor 232 also rotates the cam 113 to move the restriction guide 112 in contact with the cam 113. In other words, in the media conveying apparatus 200, the cam 113 is rotatable by the second motor 232 and the restriction guide 112 is movable by the second motor 232.

The third motor 233 and the third transmission assembly 233*a* have substantially the same configurations as the third motor 133 and the third transmission assembly 133*a*, respectively. Although the third motor 233 is coupled to the conveyance roller 119 and the ejection roller 123 via the third transmission assembly 233*a*, the third motor 233 is not coupled to the cam 113. The third motor 233 generates a driving force for driving the conveyance roller 119 and the ejection roller 123 according to control signals from the processing circuit 150. The third transmission assembly 233*a* includes one or more pulleys, belts, and gears between the third motor 233, the shaft 119*a* serving as the rotary shaft of the conveyance roller 119, and the shaft 123*a* serving as the rotary shaft of the ejection roller 123. The third transmission assembly 133*a* transmits the driving force generated by the third motor 133 to the conveyance roller 119 and the ejection roller 123. With this configuration, the third motor 133 rotates the conveyance roller 119 and the ejection roller 123 and causes the conveyance roller 119 and the ejection roller 123 to convey and eject media.

In the media conveying apparatus 200, the control unit 151 and the determination unit 152 execute the media reading process illustrated in FIGS. 8 and 9 and the multi-feed determination process illustrated in FIG. 11.

In step S103, the control unit 151 drives the third motor 233 to rotate the conveyance roller 119, the first facing roller 120, the ejection roller 123, and/or the second facing roller 124. In step S104, the control unit 151 drives the second motor 232 to rotate the separation roller 116 and rotate the cam 113 to move the restriction guide 112 from the set position to the released position. In step S105, the control unit 151 drives the first motor 131 to rotate the feed roller 115. Thus, at the start of feeding of media, the control unit 151 controls the first motor 131 and the second motor 232 to rotate the feed roller 115 after the separation roller 116 in rotating state contacts the media. Further, at the start of feeding of media, the control unit 151 operates the second motor 232 and then operates the first motor 131.

In step S107, the control unit 151 controls the second motor 232 to stop the separation roller 116. In step S113, the control unit 151 controls the second motor 232 to rotate the separation roller 116 again. In these steps, the restriction guide 112 does not move from the released position. In step S114, the control unit 151 controls the first motor 131 to rotate the feed roller 115 again. Thus, at the start of feeding of the second and following media set on the restriction guide 112, the control unit 151 controls the first motor 131 and the second motor 232 to rotate the separation roller 116 and then rotate the feed roller 115.

In step S120, the control unit 151 controls the third motor 233 to stop the conveyance roller 119, the first facing roller 120, the ejection roller 123, and/or the second facing roller 124. In step S121, the control unit 151 controls the second motor 232 to rotate the cam 113 to move the restriction guide 112 from the released position to the set position. At this time, the separation roller 116 rotates in the media feeding direction. However, no problem occurs because no medium is present on the media table 103.

In step S123, the control unit 151 controls the first motor 131 to rotate the feed roller 115. In other words, when no medium is fed, the control unit 151 controls the first motor 131 or the second motor 232 to rotate the feed roller 115 while the restriction guide 112 is located at the set position. The control unit 151 rotates the feed roller 115 to move the dust adhering to the feed roller 115 or the separation roller 116. In step S124, the control unit 151 controls the first motor 131 to stop the feed roller 115.

In steps S204, S205, and S208 of the multi-feed determination process, the control unit 151 controls the second motor 232 to stop or rotate the separation roller 116 again. In these steps, the restriction guide 112 does not move from the released position.

As described above in detail, the media conveying apparatus 200 including the common second motor 232 to drive the separation roller 116 and the restriction guide 112 can also favorably separate media. In addition, the media conveying apparatus 200 including the common second motor 232 to drive the separation roller 116 and the restriction guide 112 can also appropriately recover media in response to the occurrence of multi-feed of the medium.

Figure 14:
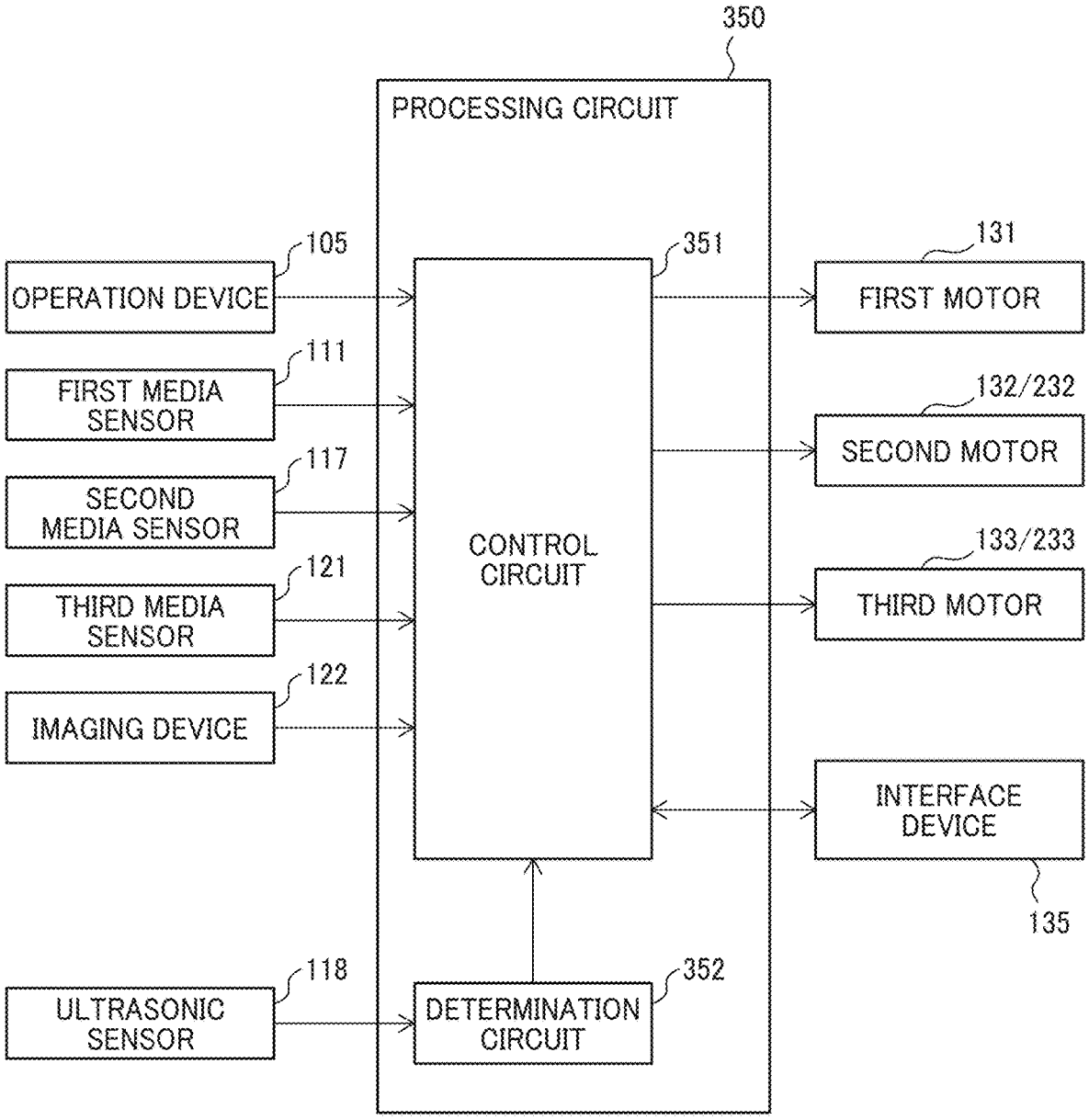
FIG. 14 is a schematic diagram illustrating a configuration of a processing circuit according to yet another embodiment of the present disclosure.

FIG. 14 is a schematic diagram illustrating a configuration of a processing circuit 350 of a media conveying apparatus according to yet another embodiment of the present disclosure. The processing circuit 350 substitutes for the processing circuit 150 of the media conveying apparatuses 100 and 200 and executes, for example, the media reading process and the multi-feed determination process instead of the processing circuit 150. The processing circuit 350 includes a control circuit 351 and a determination circuit 352. These circuits may be, for example, independent integrated circuits, microprocessors, or firmware.

The control circuit 351 is an example of a control unit and functions as the control unit 151. The control circuit 351 receives the operation signal from the operation device 105 or the interface device 135, the first media signal from the first media sensor 111, the second media signal from the second media sensor 117, and the third media signal from the third media sensor 121. The control circuit 351 receives a determination result of multi-feed of the medium from the determination circuit 352. The control circuit 351 controls the first motor 131, the second motor 132 or 232, and the third motor 133 or 233 based on the received information, acquires an input image from the imaging device 122, and outputs the input image to the interface device 135.

The determination circuit 352 is an example of a determination unit and functions as the determination unit 152. The determination circuit 352 receives the ultrasonic signal from the ultrasonic sensor 118, determines whether the multi-feed of the medium occurs based on the received ultrasonic signal, and outputs the result of determination to the control circuit 351.

As described above in detail, the media conveying apparatus including the processing circuit 350 can also favorably separate media. In addition, the media conveying apparatus including the processing circuit 350 can also appropriately recover media in response to the multi-feed of the medium.

According to one or more embodiments of the present disclosure, the media conveying apparatus, the media feeding method, and the control program can more appropriately recover media in response to the occurrence of multi-feed of the medium.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, ASICs ("Application Specific Integrated Circuits"), FPGAs ("Field-Programmable Gate Arrays"), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of a FPGA or ASIC.

The invention claimed is:

1. A media conveying apparatus comprising:

a media table;

a feed roller to feed a medium placed on the media table in a media feeding direction;

a separation roller facing the feed roller to separate the medium;

a sensor to detect multi-feed of the medium; and circuitry configured to:

in response to detection of multi-feed of the medium by the sensor, rotate the separation roller in a direction opposite to the media feeding direction to convey the medium toward the media table;

stop the rotation of the separation roller in the direction opposite to the media feeding direction after conveyance of the medium toward the media table; and restart rotation of the feed roller in the media feeding direction, wherein the feed roller rotates by the rotation of the separation roller when the medium is conveyed toward the media table, and wherein a moving speed of an outer circumferential surface of the feed roller in rotating by the rotation of the separation roller, is lower than a moving speed of an outer circumferential surface of the feed roller in feeding the medium.

2. The media conveying apparatus according to claim 1, further comprising a one-way clutch on a rotary shaft of the feed roller to limit a rotation of the feed roller about the rotary shaft in a direction opposite to a media feeding direction, wherein, in conveying the medium toward the media table, a circumferential speed of the rotary shaft of the feed roller is higher than a circumferential speed of an outer circumferential surface of the feed roller rotated by the separation roller.

3. The media conveying apparatus according to claim 1, wherein, in conveying the medium toward the media table, a moving speed of an outer circumferential surface of the feed roller is higher than a moving speed of an outer circumferential surface of the separation roller.

4. The media conveying apparatus according to claim 1, further comprising:

a restriction guide movable between a first position and a second position, wherein the restriction guide restricts the medium from contacting with the feed roller and the separation roller at the first position and does not restrict the medium from contacting the medium from contacting with the feed roller and the separation roller at the second position;

a conveyance roller downstream from the feed roller and the separation roller in the media conveyance direction; and a first motor to drive the feed roller;

a second motor to drive the separation roller;

a third motor to move the restriction guide and drive the conveyance roller.

5. The media conveying apparatus according to claim 1, further comprising a medium sensor downstream from the feed roller in the media feeding direction, wherein the circuitry stops the separation roller and the feed roller after conveyance of the medium toward the media table in response to detection of the medium by the medium sensor.

6. The media conveying apparatus according to claim 5, wherein the circuitry determines that a leading end of the medium passes a nip between the feed roller and the separation roller in response to detection of the medium by the medium sensor when feeding of the medium.

7. The media conveying apparatus according to claim 1, wherein a moving speed of an outer circumferential surface of the separation roller in conveying the medium toward the media table, is lower than a moving speed of an outer circumferential surface of the feed roller in feeding the medium.

8. A media feeding method, comprising:

feeding a medium placed on a media table in a media feeding direction by a feed roller;

separating the medium by a separation roller facing the feed roller;

in response to detection of multi-feed of the medium by a sensor to detect multi-feed of the medium, rotating the separation roller in a direction opposite to the media feeding direction to convey the medium toward the media table;

stopping the rotation of the separation roller in the direction opposite to the media feeding direction after conveyance of the medium toward the media table; and restarting rotation of the feed roller in the media feeding direction, wherein the feed roller rotates by the rotation of the separation roller when the medium is conveyed toward the media table, and wherein a moving speed of an outer circumferential surface of the feed roller in rotating by the rotation of the separation roller, is lower than a moving speed of an outer circumferential surface of the feed roller in feeding the medium.

9. A non-transitory recording medium storing a plurality of instructions which, when executed by one or more processors, causes the one or more processors to perform a method for controlling a media conveying apparatus including a feed roller to feed a medium placed on a media table in a media feeding direction, and a separation roller facing the feed roller to separate the medium, the method comprising:

in response to detection of multi-feed of the medium by a sensor to detect multi-feed of the medium, rotating the separation roller in a direction opposite to the media feeding direction to convey the medium toward the media table;

stopping the rotation of the separation roller in the direction opposite to the media feeding direction after conveyance of the medium toward the media table; and restarting rotation of the feed roller in the media feeding direction, wherein the feed roller rotates by the rotation of the separation roller when the medium is conveyed toward the media table, and wherein a moving speed of an outer circumferential surface of the feed roller in rotating by the rotation of the separation roller, is lower than a moving speed of an outer circumferential surface of the feed roller in feeding the medium.

* * * * *